US009908321B1

(12) United States Patent
Kalvani

(10) Patent No.: US 9,908,321 B1
(45) Date of Patent: Mar. 6, 2018

(54) SYSTEMS AND METHODS FOR IDENTIFYING CARTRIDGE CASES BASED ON INK MARKING

(71) Applicant: Kalvani IP Holdings, LLC, South Barrington, IL (US)

(72) Inventor: Bimal A. Kalvani, South Barrington, IL (US)

(73) Assignee: Kalvani IP Holdings, LLC, South Barrington, IL (US)

( * ) Notice: Subject to any disclaimer, the term of this patent is extended or adjusted under 35 U.S.C. 154(b) by 5 days.

(21) Appl. No.: 15/141,610

(22) Filed: Apr. 28, 2016

(51) Int. Cl.
*B41F 17/00* (2006.01)
*F42B 5/28* (2006.01)

(52) U.S. Cl.
CPC ..... *B41F 17/00* (2013.01); *F42B 5/28* (2013.01)

(58) Field of Classification Search
USPC ..... 101/35
See application file for complete search history.

(56) References Cited

U.S. PATENT DOCUMENTS 3,048,105 A 8/1962 Schlatter
5,317,967 A * 6/1994 Heidenreich ..... B41F 15/0886 101/127.1
6,672,219 B2 1/2004 Mackerell et al.
6,810,816 B2 11/2004 Rennard
7,143,697 B2 12/2006 Mace et al.
7,823,495 B2 11/2010 Martini Filho
8,875,632 B2 11/2014 Jaehnichen
9,052,176 B1 * 6/2015 Stefano ..... F42B 33/14
2004/0169690 A1 * 9/2004 Morton ..... B41J 3/4073 347/4
2016/0216087 A1 * 7/2016 Raemy ..... F42B 5/025

OTHER PUBLICATIONS

Hornady Manufacturing Company, "Homady Handbook of Cartridge Reloading," 9th Edition, pp. 56-57, 2012.

* cited by examiner

*Primary Examiner* — Rodney Fuller
(74) *Attorney, Agent, or Firm* — Sheppard Mullin Richter & Hampton LLP

(57) ABSTRACT

Systems and methods can removably secure a set of cartridge cases on a first platform. A set of marking elements can be provided on a second platform. At least one of the first platform or the second platform can be moved to shorten a distance between the first platform and the second platform. At least a subset of the set of marking elements can thereby be enabled to mark at least a subset of the set of cartridge cases. In some cases, the first platform can be configured to removably secure the set of cartridge cases. The second platform can be configured to provide the set of marking elements. One or more moving mechanisms can be configured to facilitate moving the at least one of the first platform or the second platform.

18 Claims, 29 Drawing Sheets

SYSTEMS AND METHODS FOR IDENTIFYING CARTRIDGE CASES BASED ON INK MARKING

FIELD OF THE INVENTION

The present technology relates to the field of mechanical components. More particularly, the present technology relates to techniques for identifying firearms ammunition cartridge casing based on ink marking.

BACKGROUND

People often utilize modern firearms like handguns and long-guns (e.g., revolvers, pistols, rifles, shotguns), such as at shooting ranges, for tactical training, while hunting, while competing in shooting sports, or for various other purposes. Before a user shoots a firearm, the user generally has to load the firearm with ammunition, such as in the form of one or more cartridges. There are a wide variety of standard cartridge calibers. Moreover, many different caliber firearms are available, for instance, and they require specific standard caliber cartridges designed to properly operate in the firearm (e.g., .45 ACP ammunition is designed for .45 ACP chambered semi-automatic pistol or 30-06 cartridge is designed for 30-06 chambered rifle). Further, the cartridges can be of various bullet weights and designs, gunpowder loads, casings design and materials and primer types depending on shooter preferences, firearm and end use.

Often times, using a significant amount of factory manufactured ammunition can be financially expensive or otherwise costly. Further, factory manufactured ammunition together with factory manufactured firearms have broader dimensional tolerances to function properly in a wide variety of combinations, thus compromising certain levels of accuracy, versus a cartridge custom manufactured for an individual firearm by improving the cartridge chambering, bullet alignment, bullet speed, bullet type, etc., when fired. As such, in some cases, users may desire to make (reload or hand-load) their own cartridges from all new components and/or to reuse at least the recyclable portion(s) of fired cartridges. In general, an ammunition cartridge (i.e., ammo, ammunition or cartridge) includes a bullet (the projectile), a cartridge case (i.e., case, casing, shell, brass), a primer, and gunpowder. In one example, a user who has fired his or her firearm can attempt to reuse the spent or fired casing from his or her own firearm. Further, the brass can be the most expensive component of the total cartridge cost. Additionally, the once fired brass properly resized and recycled back into the same firearm can improve the chambering and bullet alignment, thus also improving the accuracy of the firearm. Further, brass can be reused a limited number of times before metal properties degrade causing safety hazards in reusing the cartridge, and thus the history of a case is also important.

SUMMARY

Various embodiments of the present disclosure can include systems and methods configured to removably secure a set of cartridge cases on a first platform. A set of marking elements can be provided on a second platform. At least one of the first platform or the second platform can be moved to shorten a distance between the first platform and the second platform. At least a subset of the set of marking elements can thereby be enabled to mark at least a subset of the set of cartridge cases. In some cases, the first platform can be configured to removably secure the set of cartridge cases. The second platform can be configured to provide the set of removably secure interchangeable marking elements. One or more moving mechanisms can be configured to facilitate moving the at least one of the first platform or the second platform.

In an embodiment, a set of case ejection elements can be provided on a third platform. The third platform can be moved to shorten a distance between the third platform and the first platform. At least the subset of the set of cartridge cases removably secured on the first platform can be ejected based on at least a subset of the set of case ejection elements. In some cases, the third platform can be configured to provide the set of case ejection elements.

In an embodiment, at least the subset of the set of cartridge cases can be ejected into a case collection element. In some cases, the case collection element can be configured to receive at least the subset of the set of cartridge cases subsequent to being ejected.

In an embodiment, a defined alignment can be maintained, within an allowable deviation, between the first platform and the second platform (and individually secured cartridge cases and respective marking elements). In some cases, one or more alignment mechanisms can be configured to maintain, within the allowable deviation, the defined alignment between the first platform and the second platform (and the individually secured cartridge cases and the respective marking elements).

In an embodiment, the defined alignment can be linear. A direction associated with the defined alignment can be at least one of horizontal or vertical. The direction can be perpendicular with respect to the first platform and the second platform.

In an embodiment, each cartridge case in the subset of the set of cartridge cases can be marked by a respective marking element in the subset of the set of marking elements. For example, each marking element in the subset of the set of marking elements can be configured to mark a respective cartridge case in the subset of the set of cartridge cases.

In an embodiment, each cartridge case in the set of cartridge cases can be removably secured on the first platform based on a respective case holder element out of a set of case holder elements. Each case holder element in the set of case holder elements can be associated with at least one of a cutout in a rubber sheet, an elastomer sheet, a washer, a mounting pin, a caliber/case specific shell holder, or a universal shell holder. In some cases, the first platform can comprise the set of case holder elements. Each case holder element out of the set of case holder elements can be configured to removably secure a respective cartridge case out of the set of cartridge cases on the first platform.

In an embodiment, at least some case holder elements in the set of case holder elements can be interchangeable based on one or more sizes associated with the set of cartridge cases.

In an embodiment, each marking element in at least the subset of the set of marking elements can correspond to a inking tube. A smallest inner diameter of the inking tube can be greater than or equal to a largest outer diameter of each cartridge case in the subset of the set of cartridge cases. Each marking element in at least the subset of the set of marking elements can be at least one of: 1) provided with (or on) the second platform or 2) placed within a respective reloading press marking die in a set of reloading press marking dies associated with the second platform.

In an embodiment, at least one marking element in the set of marking elements can utilize at least one of a plurality of same colored inks or a plurality of differently colored inks.

In an embodiment, a cartridge case can comprise an inner case surface configured to hold a bullet (i.e., bullet core, bullet head, projectile, etc.). The cartridge case can further comprise an outer case surface configured to be removably secured via a first platform. The outer case surface can be capable of being marked by at least one marking element on a second platform when at least one of the first platform or the second platform is moved to shorten a distance between the first platform and the second platform.

It should be appreciated that many other features, applications, embodiments, and/or variations of the disclosed technology will be apparent from the accompanying drawings and from the following detailed description. Additional and/or alternative implementations of the structures, systems, and methods described herein can be employed without departing from the principles of the disclosed technology.

Figure 1:
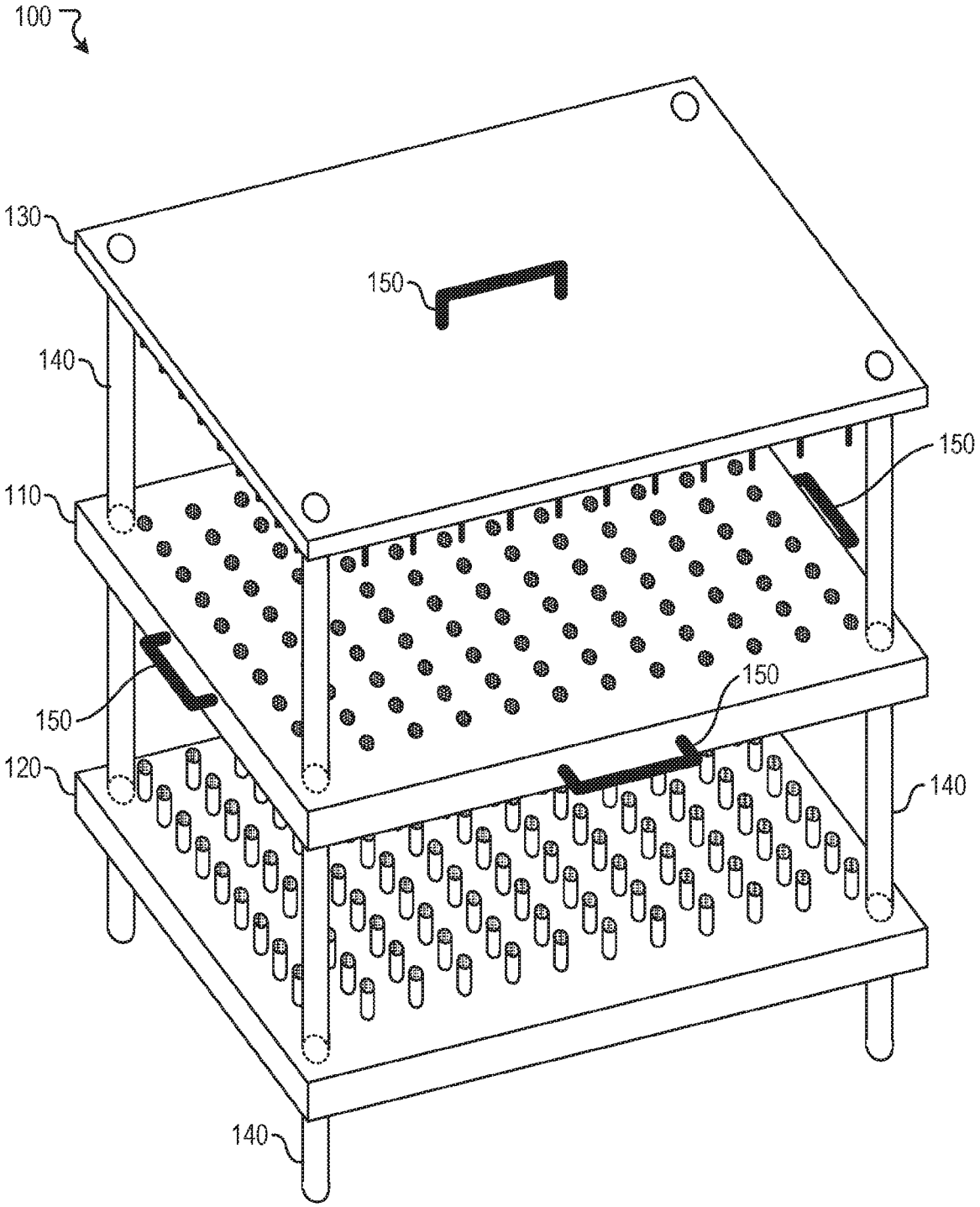
FIG. 1 illustrates an example system configured to facilitate identifying cartridge cases based on ink marking, according to an embodiment of the present disclosure.

The figures depict various embodiments of the disclosed technology for purposes of illustration only, wherein the figures use like reference numerals to identify like elements. One skilled in the art will readily recognize from the following discussion that alternative embodiments of the structures and methods illustrated in the figures can be employed without departing from the principles of the disclosed technology described herein. Moreover, it should be understood that various components or illustrations in the figures herein may not be drawn to scale.

DETAILED DESCRIPTION

Identifying Cartridge Cases Based on Ink Marking

Today, people often utilize bullet projectile-based weapons, firearms such as pistols, revolvers, rifles, shotguns, etc. For example, users may shoot firearms at ranges, during training, while hunting, during competition shooting sports, and/or for a wide variety of other purposes. In general, a user has to load a firearm with ammunition, such as with one or more cartridges, in order to shoot or fire the gun. There is a plethora of different cartridges, which can vary in type, size, and/or caliber, etc. For example, different guns can require different cartridges.

Shooting can, in many cases, be expensive or costly. For instance, shooting frequently can result in a significant amount of ammunition cartridges being used, which can cost a nontrivial amount of resources. Accordingly, some users may desire to make (hand-load or reload) their own ammunition cartridges and/or to reuse at least a portion of a cartridge component. A cartridge can generally include a bullet (projectile), a cartridge case (i.e., case, casing, cartridge, shell, brass, etc.), a primer, and gunpowder. In order to reduce costs, a user can attempt to make his or her own ammunition and/or to reuse cartridge cases. However, in accordance with conventional approaches, if multiple users are shooting together or nearby one another, different cartridge cases used by the multiple users can become mixed together upon ejection from firearms, such as by falling on the ground and becoming mixed together. Further, the ejected spent brass may be of the same caliber or of a different caliber cartridge. Thus, a user may be unable to, or may face challenges in attempting to, recognize or identify and recover which cartridge cases are used in his or her firearm. As such, if the user does not identify which cartridge cases are his or hers, then the user will be unable to recover and reuse those cases, or the user might mistakenly retrieve cases fired from another firearm with unknown history and then unknowingly create a safety hazard, or the user must take additional steps for above normal inspection of individual cases, thereby resulting in additional costs (e.g., money, time, effort, etc.) when reloading cartridges. Also, for various safety reasons, it can be important for the user to correctly identify and use only those cartridge cases that he or she is familiar with (e.g., cartridge cases that he or she knows the usage history thereof, cartridge cases that are his or hers, etc.). Accordingly, conventional approaches can create challenges for or reduce the overall experience associated with utilizing bullet projectile-based weapons, such as firearms.

Due to these or other concerns, conventional approaches can be disadvantageous or problematic. Therefore, an improved approach can be beneficial for addressing or alleviating various drawbacks associated with conventional approaches. The disclosed technology can facilitate identifying cartridge cases based on ink marking. Various embodiments of the present disclosure can include systems and methods configured to removably secure a set of cartridge cases on a first platform. A set of marking elements can be provided on a second platform. At least one of the first platform or the second platform can be moved to shorten a distance between the first platform and the second platform. At least a subset of the set of marking elements can thereby be enabled to mark at least a subset of the set of cartridge cases. In some cases, the first platform can be configured to removably secure the set of cartridge cases. The second platform can be configured to provide the set of marking elements (which can be removably secured and/or interchangeable). One or more moving mechanisms can be configured to facilitate moving the at least one of the first platform or the second platform. It is contemplated that there can be many variations and/or other possibilities associated with the disclosed technology.

FIG. 1 illustrates an example system 100 configured to facilitate identifying cartridge cases based on ink marking, according to an embodiment of the present disclosure. As shown in FIG. 1, the example system 100 can include a first platform 110, a second platform 120, and a third platform 130. Platforms can, for instance, also be referred to as plates, boards, sheets, panels, or clamps, etc. The components (e.g., platforms, elements, etc.) shown in this figure and all figures herein are exemplary only, and other implementations may include additional, fewer, integrated, or different components. Some components may not be shown so as not to obscure relevant details. Further, it should be understood that various components or illustrations in the figures herein may not be drawn to scale.

In some embodiments, the first platform 110 can be configured to facilitate removably securing a set of cartridge cases. For instance, each cartridge case in the set of cartridge cases can be secured or held substantially in place (i.e., held within an allowable spatial deviation from being in a fixed position) via the first platform 110. In this instance, the first platform 110 can utilize a set of case holder elements (e.g., case holding holes, case holding pins, etc.) to removably secure the set of cartridge cases. However, each cartridge case in the set of cartridge cases is also capable of being removed from its respective position that is secured or held via the first platform 110. More details regarding the first platform 110 will be provided below with reference to FIG. 4 and FIG. 5.

Moreover, in some implementations, the second platform 120 can be configured to facilitate providing a set of marking elements (i.e., ink marking elements, inking elements, ink markers, markers, etc.). As such, in some cases, when at least one of the first platform 110 or the second platform 120 is moved to shorten a distance between the first platform 110 and the second platform 120, at least a subset of the set of marking elements can be enabled to label, paint, decorate, color, and/or otherwise mark at least a subset of the set of cartridge cases. In some cases, the marking elements can be twist-locked with caliber specific diameters. In some instances, the second platform can be entirely replaced with a different second platform having different (e.g., different diameter) marking elements. In some cases, ink utilized with the disclosed technology can be self-contained within marking elements and/or can utilize a common arterial tube-to-ink-pad irrigation system from a bulk ink bottle/well. In the example system 100 of FIG. 1, when the first platform 110 is moved or lowered toward the second platform 120 (or the second platform 120 can be moved or lifted toward the first platform 110, or both platforms can be moved together, etc.), cartridge cases removably secured via the first platform 110 can be marked utilizing the second platform 120. Additionally, although the set of marking elements is illustrated to protrude upward in this example, the set of marking elements can, in some embodiments, be entirely (or can be within an allowable deviation from being entirely) embedded within the second platform 120, such that the top surface of the second platform 120 is substantially flat or flush. The second platform 120 will be discussed in more detail below with reference to FIG. 6.

Furthermore, in some embodiments, the third platform 130 can be configured to facilitate providing a set of case ejection elements (e.g., case ejecting pins). In some instances, the third platform 130 (and/or the first platform 110) can be moved to shorten a distance between the third platform 130 and the first platform 110. Subsequently, at least the subset of the set of cartridge cases removably secured on the first platform 110 can be ejected based on at least a subset of the set of case ejection elements. In the example system 100 of FIG. 1, when the third platform 130 is moved or lowered toward the first platform 110 (or the first platform 110 can be moved or lifted toward the third platform 130, or both platforms can be moved together, etc.), cartridge cases removably secured via the first platform 110 can be ejected utilizing the third platform 130. More details regarding the third platform 130 will be provided below with reference to FIG. 3.

Additionally, in some implementations, the example system 100 can include one or more alignment mechanisms 140 (e.g., alignment rods, guiding pins, poles, etc.) configured to maintain, within an allowable deviation, a defined alignment between the first platform 110 and the second platform 120. The one or more alignment mechanisms 140 can also maintain, within an allowable deviation, a defined alignment between the first platform 110 and the third platform 130. In this example, the defined alignment can be linear, a direction associated with the defined alignment can be vertical, and the direction can be perpendicular with respect to the first platform 110 and the second platform 120 (as well as the third platform 130). In some embodiments, a linear horizontal alignment can be utilized as well. In some cases, other alignments (e.g., diagonal alignments, non-linear alignments, etc.) can also be utilized. As shown in the example of FIG. 1, the one or more alignment mechanisms 140 can maintain alignment between the first platform 110, the second platform 120, and/or the third platform 130. The one or more alignment mechanisms can further serve as footing to enable the example system 100 to stand vertically, as shown.

Moreover, in some embodiments, the example system 100 can include one or more handles 150 to facilitate moving various platforms. For instance, the one or more handles 150 can enable manual labor to be used to move at least some of the platforms (e.g., the first platform 110, the third platform 130, etc.). It is contemplated that all examples herein are provided for illustrative purposes and that there can be many variations associated with the disclosed technology. For instance, in some cases, one or more levers, mechanical presses, manual presses, automatic presses, and/or other moving mechanisms, etc., can be utilized to facilitate moving various platforms.

Figure 2:
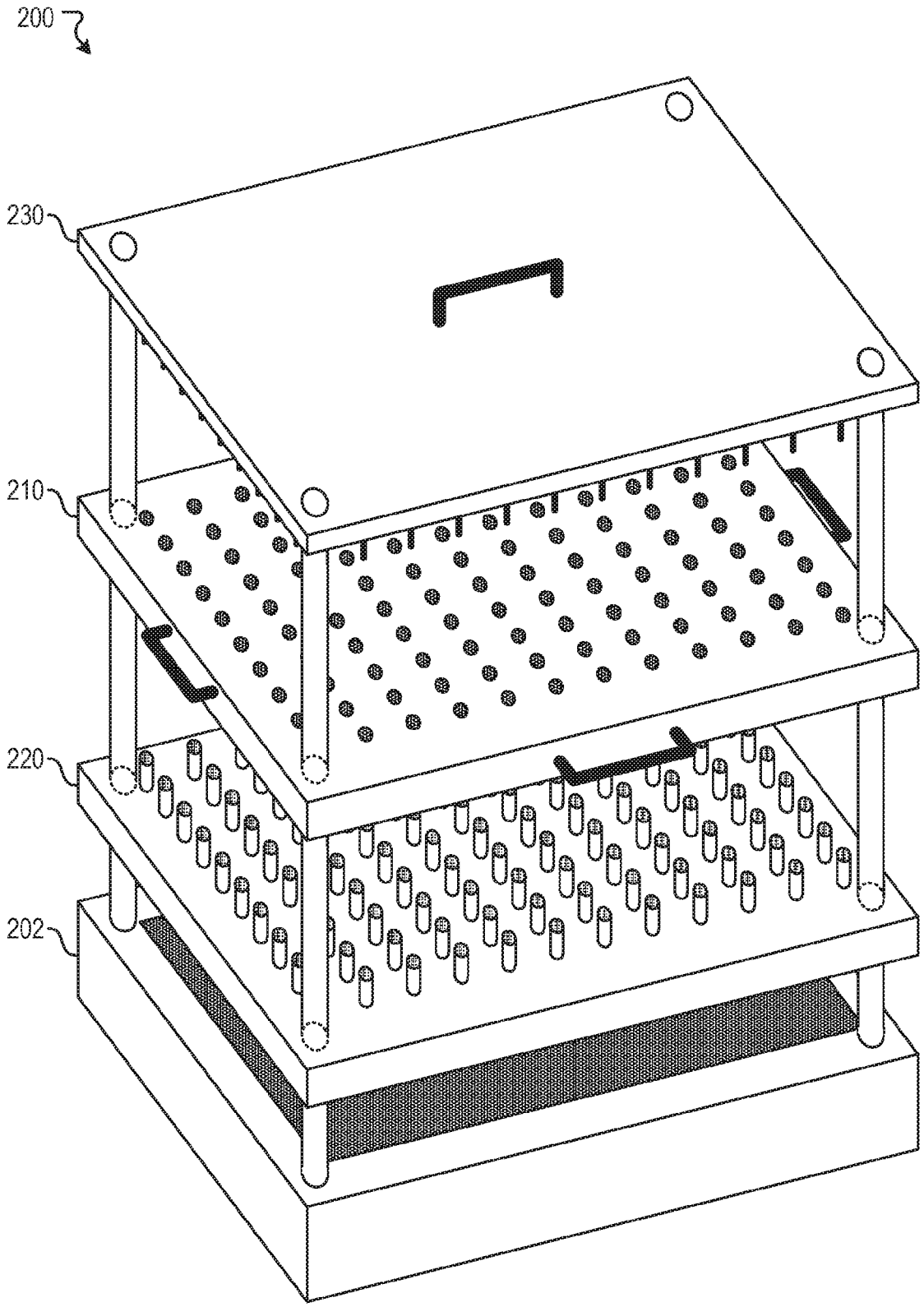
FIG. 2 illustrates an example system configured to facilitate identifying cartridge cases based on ink marking, according to an embodiment of the present disclosure.

FIG. 2 illustrates an example system 200 configured to facilitate identifying cartridge cases based on ink marking, according to an embodiment of the present disclosure. The example system 200 can include a case collection element 202 (e.g., a case collection bin, a case collection box, a case collection plate, etc.), which can be positioned under a first platform 210, a second platform 220, and a third platform 230 (e.g., the first platform 110, the second platform 120, and the third platform 130 of FIG. 1, respectively).

In the example system 200 of FIG. 2, cartridge cases that are removably secured to the first platform 210 can be marked, labeled, painted, or colored, etc., by the second platform 220 when the first platform 210 and the second platform 220 are moved or clamped together. Moreover, at least some of the marked cartridge cases can be ejected by the third platform 230 when the first platform 210 and the third platform 230 are moved or clamped together. As such, the marked cartridge cases can be removed or ejected, and can pass through the second platform 220, thereby falling into the case collection element 202. In some implementations, the case collection element 202 can be movable and/or detachable from the example system 200 for convenient access to the marked and ejected cartridge cases. Again, many variations associated with the disclosed technology are possible.

Figure 3:
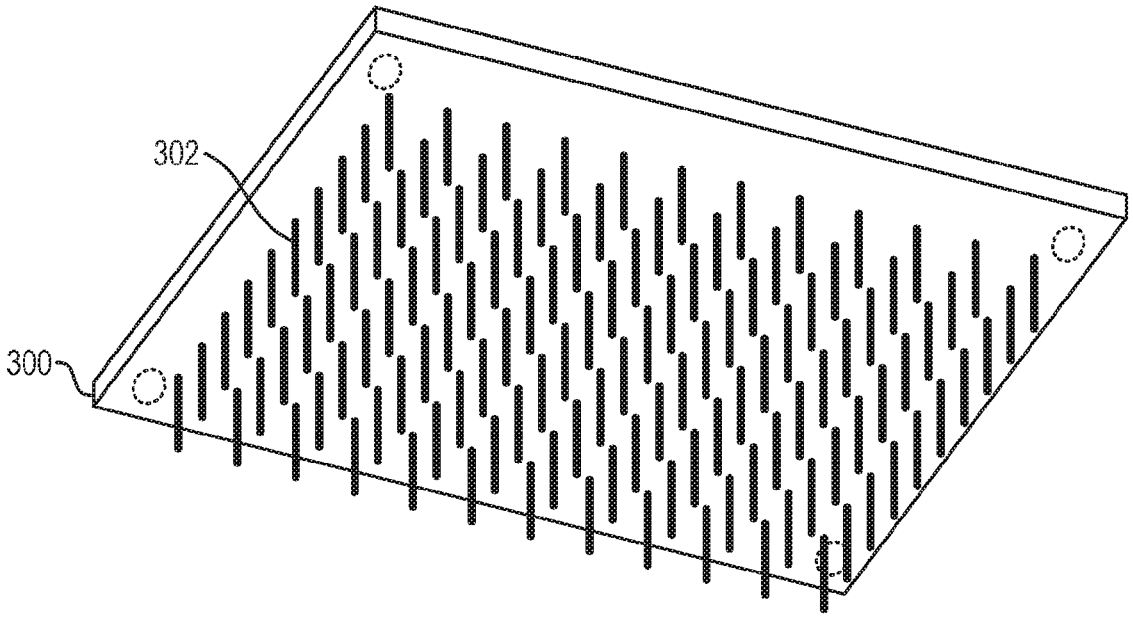
FIG. 3 illustrates an example platform configured to facilitate ejecting cartridge cases subsequent to being identified based on ink marking, according to an embodiment of the present disclosure.

FIG. 3 illustrates an example platform 300 configured to facilitate ejecting cartridge cases subsequent to being identified based on ink marking, according to an embodiment of the present disclosure. In some embodiments, the example platform 300 can be implemented as the example third platform 130 of FIG. 1. FIG. 3 illustrates a view of the example platform 300 from a bottom perspective. In the example of FIG. 3, the platform 300 can be shown to provide a set of one or more case ejection elements, such as at least one case ejecting pin 302.

In some cases, when the example platform 300 is moved or clamped with another platform (i.e., a securing platform) that removably secures cartridge cases, the case ejection elements (e.g., the at least one case ejecting pin 302) can push or eject the removable cartridge cases from being held or secured by the other (securing) platform. Accordingly, at least some cartridge cases removably secured on the other (securing) platform can be ejected based on at least some of the set of case ejection elements, such as the at least one case ejecting pin 302.

Moreover, in some implementations, the outer diameter of each of the case ejection elements (e.g., case ejecting pins) can be less than the smallest inner diameter of each case holder element that removably secures each cartridge case, less than the smallest cartridge case inner diameter that circumferences a cartridge head, and less than the smallest inner diameter of each marking element that marks each cartridge case. Additionally, the length of each of the case ejection elements (e.g., case ejecting pins) can vary, but can be long enough to eject the cartridge cases. In one instance, the length of a case ejection element (e.g., case ejecting pin) can be at least as long as, within an allowable deviation, the distance between one end (or a front/upper surface) of a securing platform and an opposite end (or rear/lower edge) of a case holder element in the securing platform. In another instance, the length of a case ejection element can be at least as long as, within an allowable deviation, the combined thickness of the securing platform and a marking platform when clamped together. Again, many variations are possible.

Figure 4:
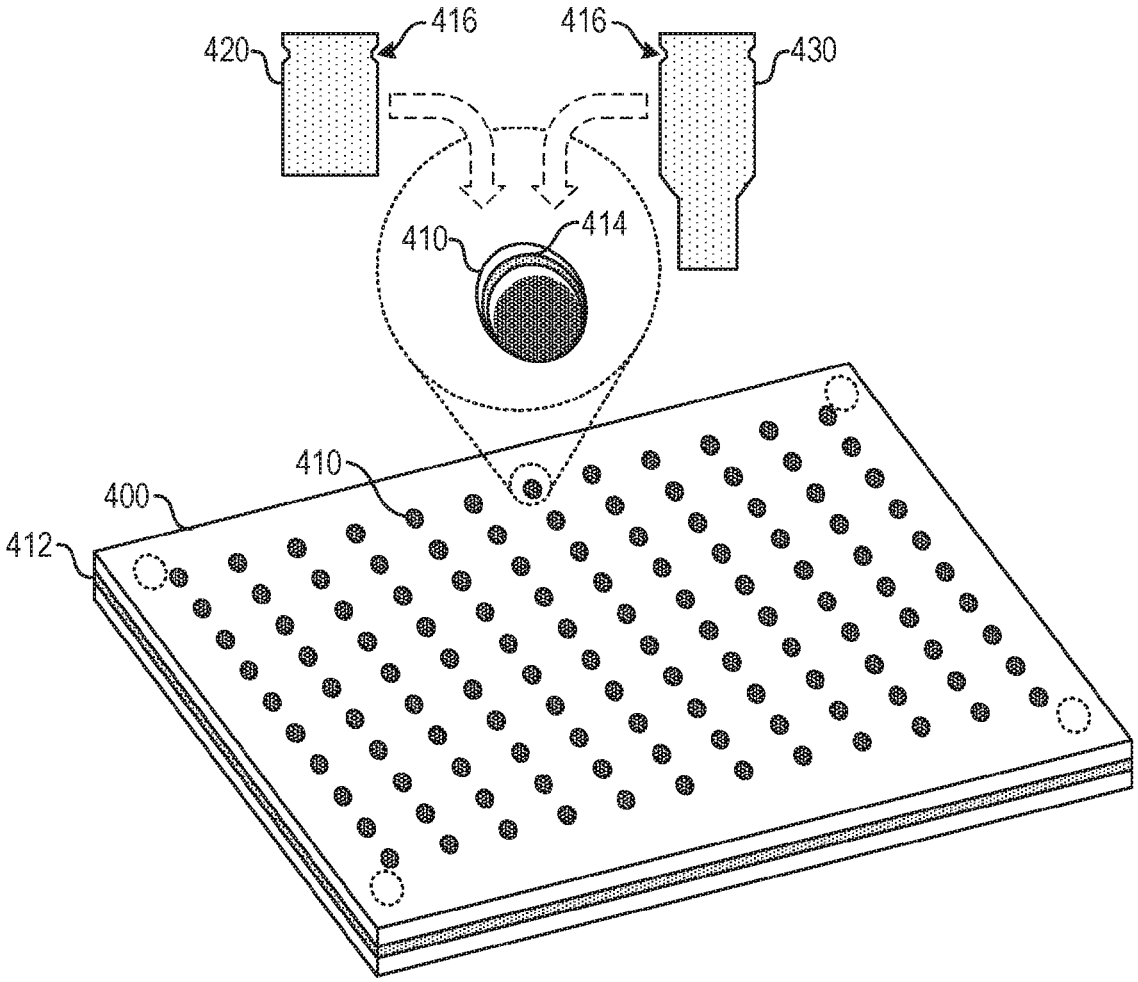
FIG. 4 illustrates an example platform configured to facilitate removably securing cartridge cases to be identified based on ink marking, according to an embodiment of the present disclosure.

FIG. 4 illustrates an example platform 400 configured to facilitate removably securing cartridge cases to be identified based on ink marking, according to an embodiment of the present disclosure. Also shown in FIG. 4 are a blown up view of a case holder element (e.g., a case holding hole or cutout 410), a blown up and cross-sectional view of a pistol cartridge case 420, and a blown-up and cross-sectional view of a rifle cartridge case 430. In some embodiments, the example platform 400 can be implemented as the first platform 110 of FIG. 1. As shown in FIG. 4, the example platform 400 can be configured to facilitate removably securing a set of cartridge cases. As such, the example platform 400 can also be referred to as a securing platform.

In some embodiments, the securing platform 400 can provide a set of case holder elements, such that each cartridge case out of the set of cartridge cases can be removably secured on the securing platform 400 by a respective case holder element out of the set of case holder elements. In one example, as shown in FIG. 4, each case holder element can correspond to a case holding hole or cutout 410. In this example, the diameter of the hole 410 cut out from the securing platform 400 can match (including being larger than) the outer diameter of each cartridge case. Moreover, in some implementations, there can be a layer or sheet 412 of rubber/elastomer (or other suitable material) within the securing platform 400. The layer or sheet 412 of rubber/elastomer (or other suitable material) can, for instance, be embedded or sandwiched within the securing platform 400. Each case holder element can also include or comprise a hole or cutout 414 in the sheet 412 of rubber/elastomer. The diameter of the hole or cutout 414 in the rubber/elastomer sheet 412 can match (including being slightly smaller than) the outer diameter of an indentation 416 within each cartridge case. In some embodiments, at least some case holder elements in the set of case holder elements can be interchangeable based on one or more sizes associated with the set of cartridge cases. For instance, the rubber/elastomer sheet 412 can be replaceable from the securing platform 400. Different rubber/elastomer sheets can include holes or cutouts that functionally removably secure different sizes (e.g., diameters, calibers, etc.) or designs (e.g., rimmed, rimless, belted, rebated) of different cartridge cases. Different rubber/elastomer sheets can be customized for different cartridge cases. Similarly, different securing platforms can be customized for different cartridge cases. More details are provided in FIG. 5.

Furthermore, various types of cartridge cases can be utilized with the disclosed technology. In one instance, the disclosed technology can be configured to operate or work with a pistol cartridge case 420, such that (at least a subset of) the set of cartridge cases can correspond to a set of pistol cartridge cases. In another instance, the disclosed technology can be configured to operate or work with a rifle cartridge case 430, such that (at least a subset of) the set of cartridge cases can correspond to a set of rifle cartridge cases. As shown in FIG. 4, pistol cartridge cases or rifle cartridge cases can be removably secured in the securing platform 400 by the case holder elements (e.g., hole 410 and rubber/elastomer cut out 414). As discussed, it should be appreciated that many variations are possible. For example, in some embodiments, each case holder element in the set of case holder elements can be associated with at least one of a washer, a mounting pin, a cartridge specific shell holder, or a universal shell holder. The mounting pin will be described in more detail below.

Figure 5:
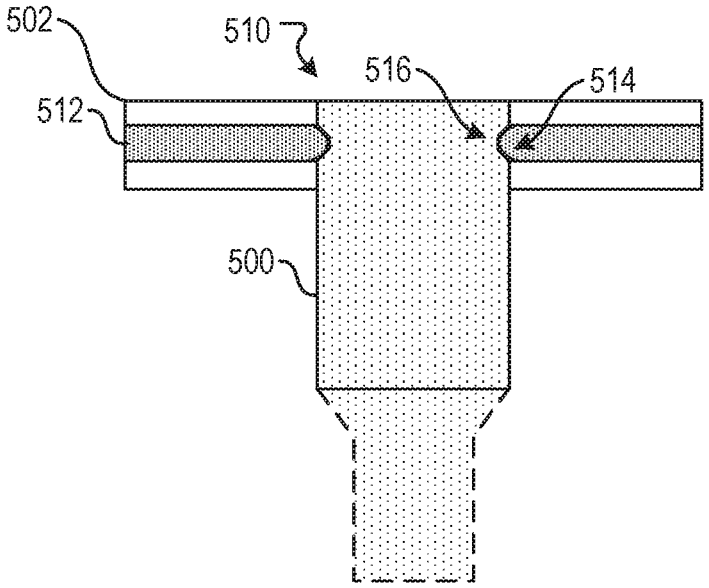
FIG. 5 illustrates a cross-sectional view of an example cartridge case removably secured within a portion of an example platform, according to an embodiment of the present disclosure.

FIG. 5 illustrates a cross-sectional view of an example cartridge case 500 removably secured within a portion of an example platform 502, according to an embodiment of the present disclosure. As shown, the example cartridge case 500 can be removably secured in the example (securing) platform 502 by a case holder element, such as a case holding hole 510. As discussed above, the cartridge case 500 can be a pistol cartridge case or a rifle cartridge case. Moreover, in this example, the case holding hole 510 can have a diameter that matches (within an allowable deviation, such as by being larger than) an outer diameter of the cartridge case 500. Furthermore, the case holding hole 510 can comprise, include, or incorporate a hole 514 cut out from a rubber/elastomer sheet 512 that is embedded within the example (securing) platform 502. The diameter of the hole or cutout 514 in the rubber/elastomer sheet 512 can match (i.e., match within an allowable deviation, such as by being slightly smaller than) the outer diameter of an indentation 516 of the cartridge case 500, such that the cartridge case 500 can be removably secured in the example (securing) platform 502.

Figure 6:
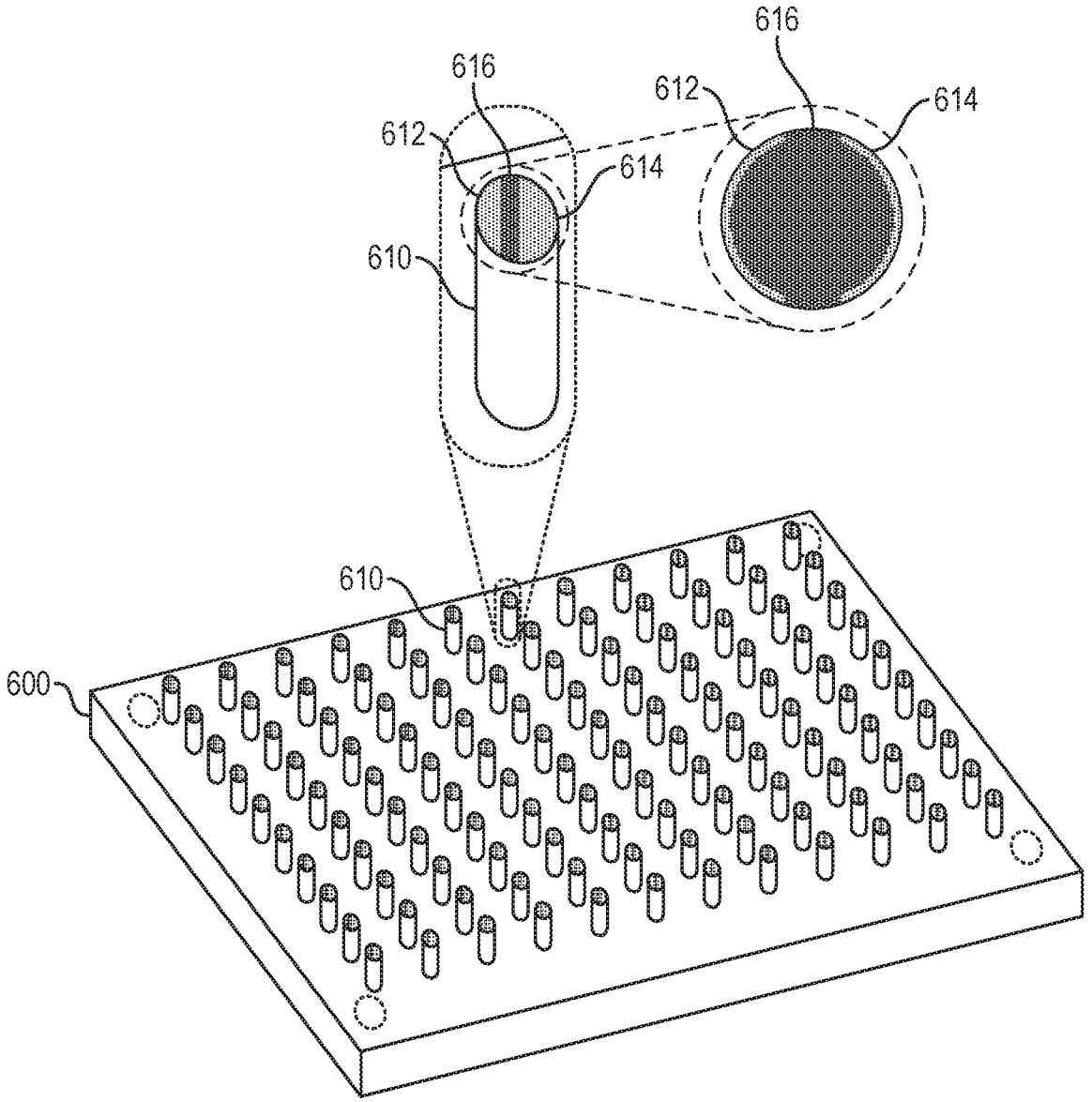
FIG. 6 illustrates an example platform configured to facilitate providing marking elements for identifying cartridge cases, according to an embodiment of the present disclosure.

FIG. 6 illustrates an example platform 600 configured to facilitate providing marking elements for identifying cartridge cases, according to an embodiment of the present disclosure. Also shown are a blown up view of an ink marking tube 610 as well as a blown up and top view of the ink marking tube 610. The example platform 600 can be configured to facilitate providing a set of marking elements. Accordingly, the example platform 600 can also be referred to as a marking platform. In some cases, each cartridge case in a subset of a set of cartridge cases removably secured via a securing platform can be marked by a respective marking element in a subset of the set of marking elements provided by the marking platform 600. For example, each marking element in the subset of the set of marking elements can be configured to mark a respective cartridge case in the subset of the set of cartridge cases.

In the example of FIG. 6, the set of marking elements can include at least one ink marking tube 610 (i.e., inking tube, coloring die, etc.). In this example, the at least one ink marking tube 610 can include two ink marking pads (i.e., ink marking tips, ink felt tips, ink felt pads, ink marking heads, etc.), such as a first porous marker pad 612 and a second porous marker pad 614. For instance, the disclosed technology can cause the at least one ink marking tube 610 to be manufactured to include the two ink marking pads, which can be attached or adhered to the inner portions of the at least one ink marking tube 610. There can, for example, be a gap or some spacing 616 between each of the first porous marker pad 612 and the second porous marker pad 614. Moreover, in some implementations, the at least one ink marking tube 610 can be hollow (with the exception of the ink marking pads), such that a cartridge case (not shown in FIG. 6) can pass through the at least one ink marking tube 610 (and through the marking platform 600) while being marked by the tube's ink marking pads (e.g., pad 612 and pad 614).

Furthermore, in some embodiments, the quantity of ink marking pads within the at least one ink marking tube 610 can vary. In one instance, there can be a single ink marking pad. A particular user can utilize the single ink marking pad to mark, paint, label, tag, and/or color, etc., the particular user's cartridge cases such that those cartridge cases can be identified or recognized by the particular user. In this instance, the particular user can differentiate those cartridge cases from other unmarked cartridge cases. Moreover, the particular user can choose a single color for the single ink marking pad that marks his or her cartridge cases to differentiate from other cartridge cases that are marked with a different color(s), which can belong to or be associated with the particular user or another user(s). In another instance, there can be more than two ink marking pads, which can utilize the same color or different colors. Accordingly, in some cases, at least one marking element in the set of marking elements can utilize at least one of a plurality of same colored inks or a plurality of differently colored inks. In general, a higher quantity of ink marking pads and/or a higher quantity of different colors can produce cartridge case markings that have higher likelihoods of being unique, which can be advantageous for identifying cartridge cases. It is contemplated that any suitable number of ink marking pads can be utilized with the disclosed technology. Additionally, the sizes of the ink marking pads can vary, such that markings placed, painted, colored, and/or inked, etc., onto cartridge cases can vary in size and/or shape as well. Again, many variations are possible. For instance, although not explicitly illustrated in FIG. 6, in some implementations, ink marking tubes can be substantially or entirely embedded within the marking platform.

Figure 7:
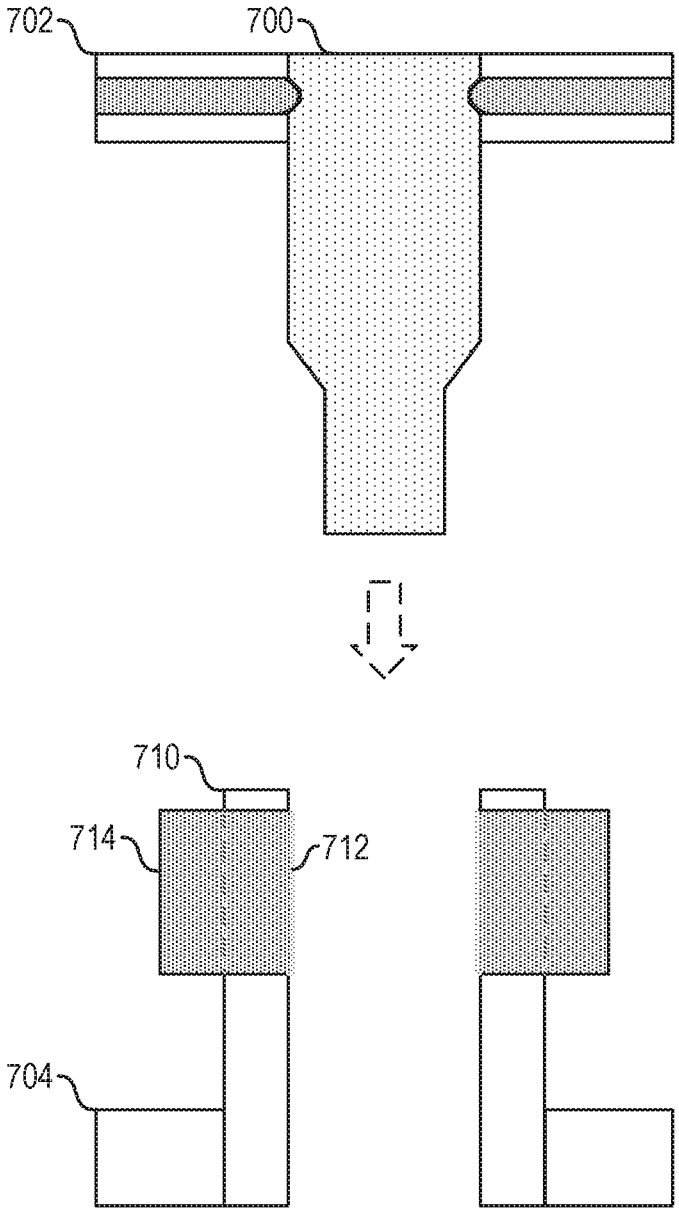
FIG. 7 illustrates a cross-sectional view of an example removably secured cartridge case and a cross-sectional view of an example marking element to mark the cartridge case, according to an embodiment of the present disclosure.

FIG. 7 illustrates a cross-sectional view of an example removably secured cartridge case 700 and a cross-sectional view of an example marking element 710 to mark the cartridge case 700, according to an embodiment of the present disclosure. In some embodiments, the marking element 710 can correspond to an ink marking tube, such as the ink marking tube 610 of FIG. 6. As shown in FIG. 7, the example cartridge case 700 can be removably secured to an example securing platform 702. Moreover, when the example securing platform 702 is moved closer to or clamped together (i.e., clamped together as much as possible) with an example marking platform 704, the cartridge case 700 can be marked by the marking element 710 associated with the marking platform 704. The cartridge case 700 can, in some instances, be marked and pass through the marking element 710 and the marking platform 700.

In the example of FIG. 7, the ink marking tube 710 can include at least one ink marking pad 712 for marking the cartridge case 700. Moreover, in some implementations, each ink marking pad can be associated with a respective ink well (or tank, repository, etc.) 714. The respective ink well 714 can facilitate supplying or replenishing each ink marking pad 712 with ink, color, or paint, etc. In some cases, the ink marking pad 712 and the ink well 714 can form a marking ring (e.g., a cartridge case coloring ring, an ink applicator ring, etc.), which can be removable, replaceable, and/or interchangeable, etc. It is contemplated that the ink marking tube 710 (including its various components and/or portions) can vary in shape, size, arrangement, and/or form, etc.

Additionally, in this example, the cartridge case 700 can correspond to a rifle cartridge case with a narrowed tip/end (neck). The narrowed tip of the cartridge case 700 can increase the likelihood that the cartridge case 700 will (self-align and) smoothly enter the ink marking tube 710. The ink marking tube 710 can have an inner diameter that matches (within an allowable deviation) the largest outer diameter of the cartridge case 700, such that the at least one ink marking pad 712 can make physical contact with and mark the outer surface of the cartridge case 700. In some cases, a smallest inner diameter of each ink marking tube can be greater than or equal to a largest outer diameter of each cartridge case in a subset of a set of cartridge cases to be marked (e.g., such that the at least one ink marking pad 712 can make physical contact and mark the outer surface of cartridge case 700).

Figure 8:
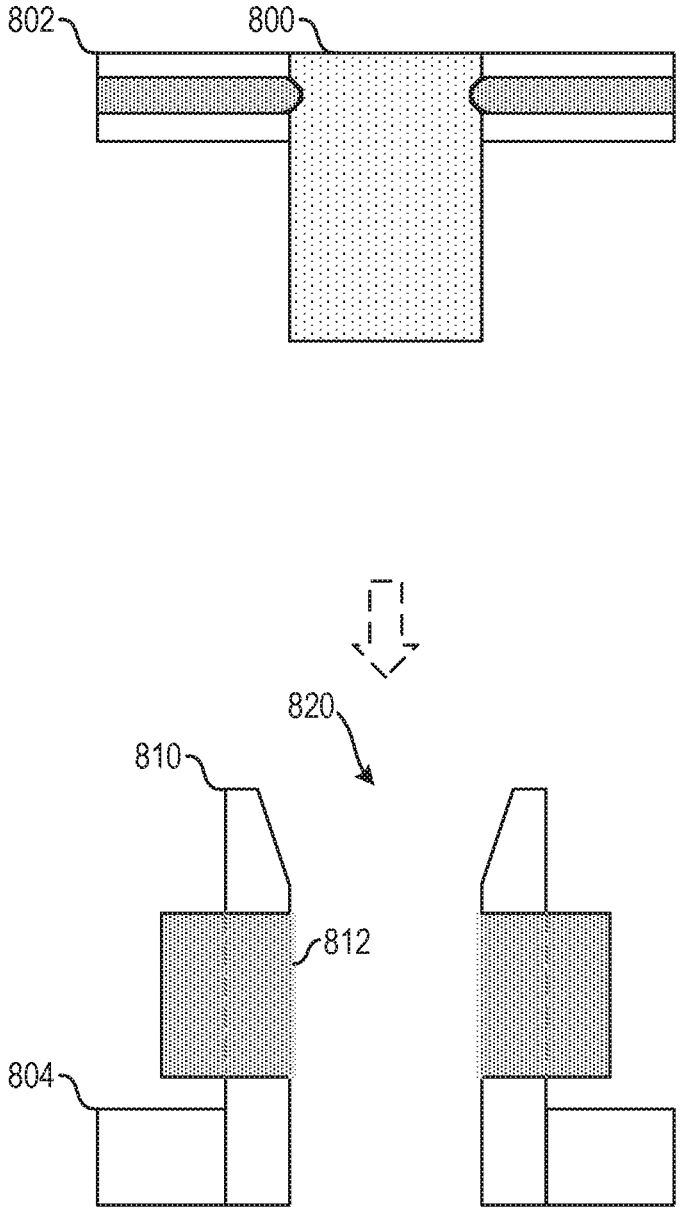
FIG. 8 illustrates a cross-sectional view of an example removably secured cartridge case and a cross-sectional view of an example marking element to mark the cartridge case, according to an embodiment of the present disclosure.

FIG. 8 illustrates a cross-sectional view of an example removably secured cartridge case 800 and a cross-sectional view of an example marking element 810 to mark the cartridge case 800, according to an embodiment of the present disclosure. In some embodiments, the marking element 810 can correspond to an ink marking tube, such as the ink marking tube 610 of FIG. 6. As shown in FIG. 8, the example cartridge case 800 can be removably secured to an example securing platform 802. Moreover, when the example securing platform 802 is moved closer to or clamped together with an example marking platform 804, the cartridge case 800 can be marked by the ink marking tube 810 associated with the marking platform 804. The cartridge case 800 can, in some instances, be marked and pass through the ink marking tube 810 and the marking platform 800.

In the example of FIG. 8, the cartridge case 800 can correspond to a pistol cartridge case (e.g., having a straight wall without a neck or narrowed tip). As such, in some embodiments, in order to increase the likelihood that the cartridge case 800 will smoothly enter the ink marking tube 810, the ink marking tube 810 can be implemented to have a wider entrance or neck 820 (e.g., a larger inner diameter at the tube's entry point such that the tube's larger inner diameter is greater than the outer diameter of the pistol cartridge case's tip/end). The ink marking tube 810 can also have a smallest inner diameter that matches, or that is greater than or equal to, (within an allowable deviation) the largest outer diameter of the cartridge case 800, such that the tube's at least one ink marking pad 812 can make physical contact with and mark the outer surface of the cartridge case 800.

Figure 9:
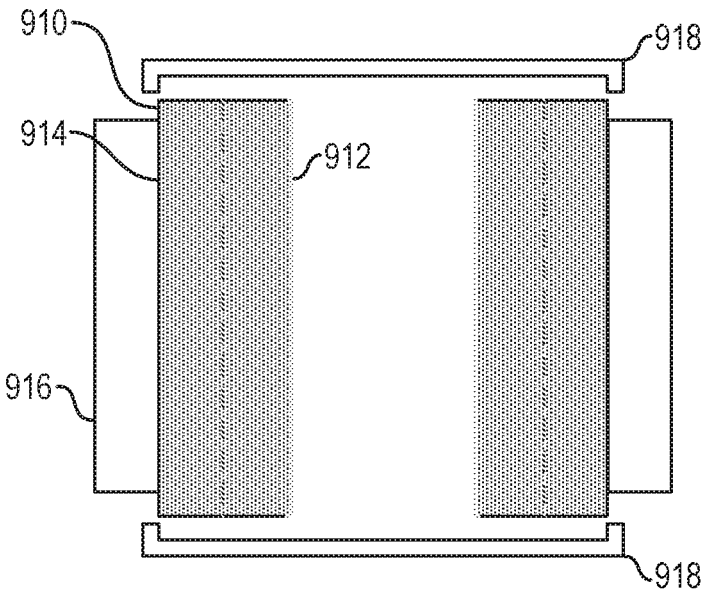
FIG. 9 illustrates cross-sectional views of examples of marking elements configured to facilitate identifying cartridge cases based on ink marking, according to an embodiment of the present disclosure.
Figure 9:
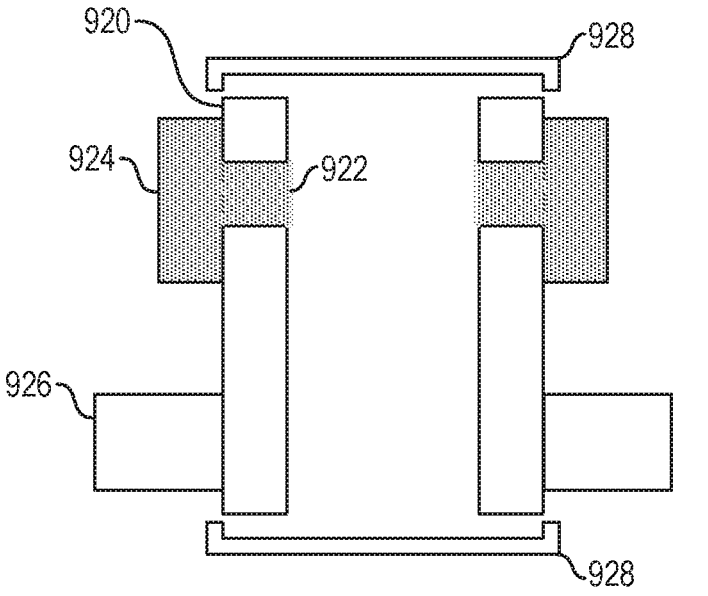

FIG. 9 illustrates cross-sectional views of examples of marking elements configured to facilitate identifying cartridge cases based on ink marking, according to an embodiment of the present disclosure. FIG. 9 can illustrate that marking elements and/or their components or portions can vary in shape, size, arrangement, and/or form, etc. In FIG. 9, there can be a first example 910 of a marking element and a second example 920 of a marking element.

The first example marking element 910 can correspond to a first example ink marking tube 910 provided via a first example marking platform 916. The first example ink marking tube 910 can include at least one ink marking pad 912 and at least one ink well 914. As shown, the at least one ink marking pad 912 and the at least one ink well 914 can form (within an allowable deviation) the entirety of the first example ink marking tube 910. Additionally, in some embodiments, the first example ink marking tube 910 can be optionally fitted with one or more caps 918 when not in use, so as to preserve the ink within the first example marking element 910 (e.g., to prevent the ink within the first example marking element 910 from drying too quickly). The one or more caps 918 can, for example, be part of a top cap layer/sheet and/or a bottom cap layer/sheet. Further, in some implementations, an ink marking tube 910 can be entirely (i.e., within an allowable deviation from being entirely) embedded within a marking platform 916.

The second example marking element 920 can correspond to second example ink marking tube 920 provided via a second example marking platform 926. The second example ink marking tube 920 can include at least one ink marking pad 922 and at least one ink well 924. As shown, the at least one ink marking pad 922 and the at least one ink well 924 can have different sizes and/or shapes, and need not form or fill the entirety of the second example ink marking tube 920. Also, in some implementations, the second example ink marking tube 920 can be optionally fitted with one or more caps 928 when not in use, so as to preserve the ink within the second example marking element 920 (e.g., to prevent the ink within the second example marking element 920 from drying too quickly). The one or more caps 928 can, for example, be part of a top cap layer/sheet and/or a bottom cap layer/sheet.

Figure 10:
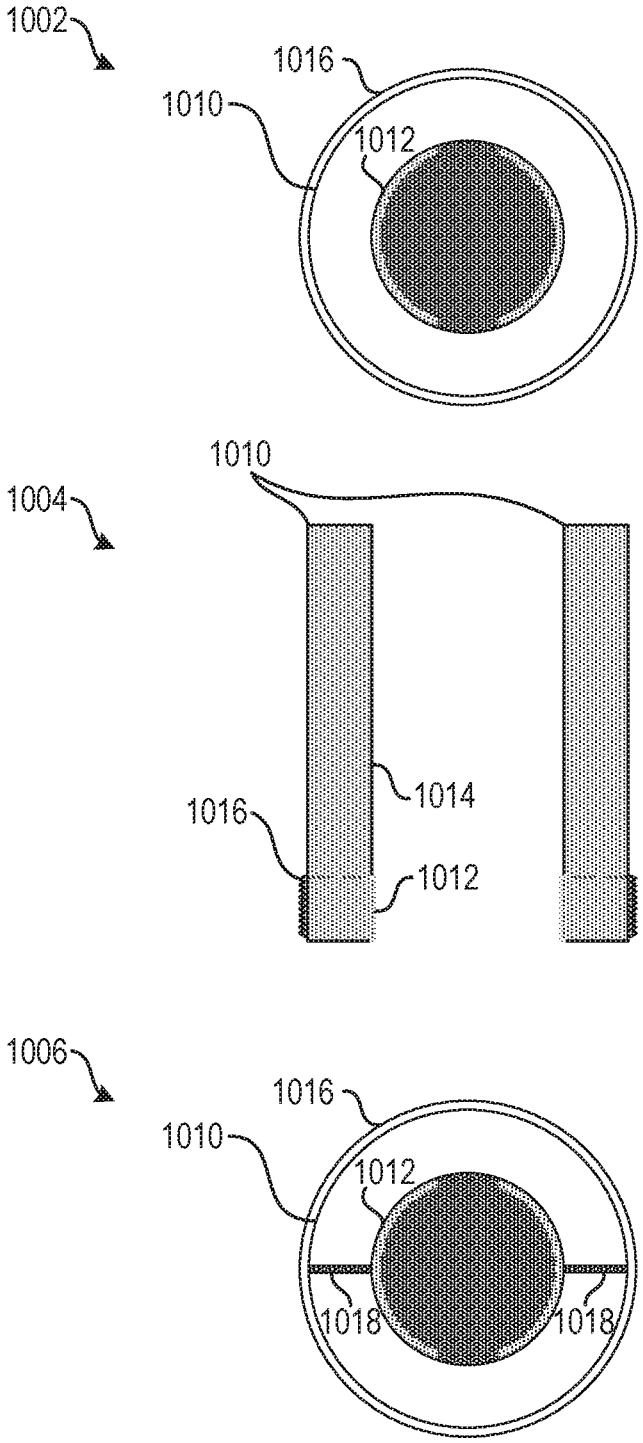
FIG. 10 illustrates example views of an example marking element configured to facilitate identifying cartridge cases based on ink marking, according to an embodiment of the present disclosure.

FIG. 10 illustrates example views of an example marking element 1010 configured to facilitate identifying cartridge cases based on ink marking, according to an embodiment of the present disclosure. FIG. 10 illustrates a top view 1002, a cross-sectional (side) view 1004, and a bottom view 1006 of the marking element 1010, such as an ink marking tube. Such an ink marking tube can be used in a marking platform or on a reloading press using a marking die, which can be removably secured in the reloading press. An example complete assembly, in accordance with some embodiments, of a marking element placed inside a marking die is shown in FIG. 12.

As shown in the example top view 1002 of FIG. 10, the ink marking tube 1010 can include at least one ink marking pad 1012 for marking cartridge cases. The ink marking tube 1010 can also be hollow, which enables a cartridge case to pass through the ink marking tube 1010 while being marked, labeled, tagged, painted, and/or colored, etc., by the at least one ink marking pad 1012. In the example cross-sectional (side) view 1004, the ink marking tube 1010 is shown to have at least one ink well 1014, which can form or fill the entirety of the ink marking tube 1010 along with the ink marking pad 1012. The cross-sectional view 1004 also shows that, in some cases, the ink marking pad 1012 and the ink well 1014 can be vertically adjacent. Additionally, the bottom view 1006 further illustrates that, in some implementations, the ink marking tube 1010 can also include screw threads (e.g., machine screw threads) 1016 for screwing the ink marking tube 1010 into an outer enclosure or portion, such as a marking die. Moreover, in some embodiments, the ink marking tube 1010 can include one or more slot heads 1018 for screwing the ink marking tube 1010 into the outer enclosure or portion, such as the marking die.

Figure 11:
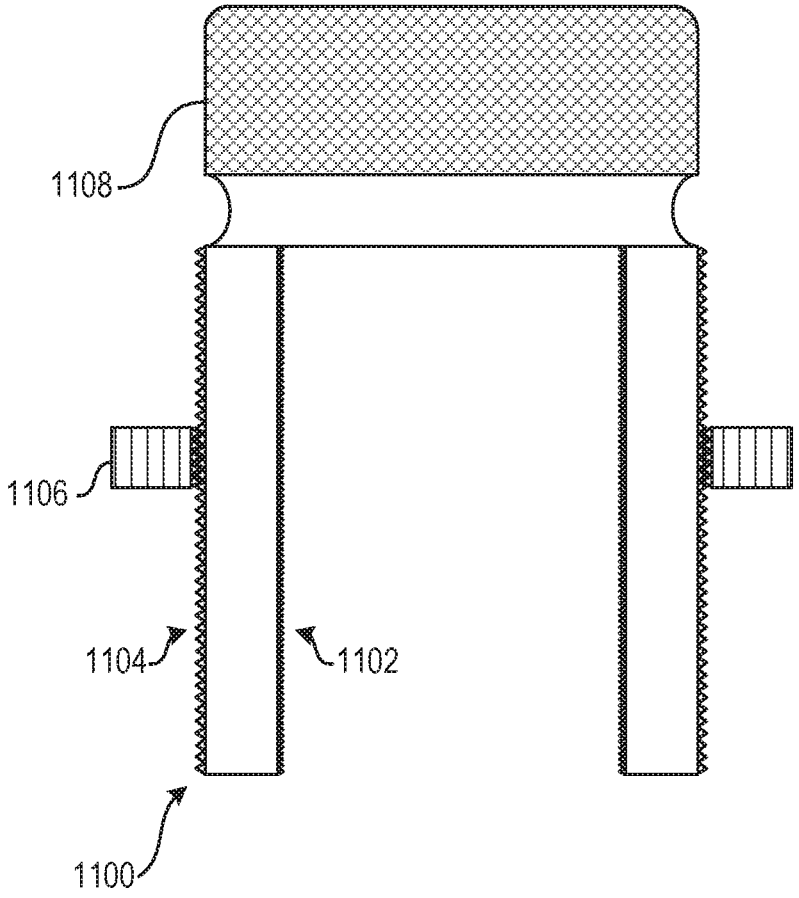
FIG. 11 illustrates a cross-sectional view of an example marking die that can be used in a reloading press configured to facilitate identifying cartridge cases based on ink marking, according to an embodiment of the present disclosure.

FIG. 11 illustrates a cross-sectional view of an example marking die 1100 that can be used in a reloading press configured to facilitate identifying cartridge cases based on ink marking, according to an embodiment of the present disclosure. As shown, in some instances, the inner surface 1102 and/or the outer surface 1104 of the marking die 1100 can have screw threads. The outer surface 1104 can, for example, have coarse threads for screwing onto a bushing for the reloading press. In some embodiments, the marking die 1100 can be directly screwed down to the reloading press. Further, in some cases, the screw threads 1016 of the ink marking tube 1010 of FIG. 10 can be screwed to the screw threads on the inner surface 1102 of the marking die 1100 of FIG. 11. In some implementations, there can also be a tube lock ring 1106 for the marking element, such as a die lock ring for locking or securing a height/location of a cartridge case coloring die/tube on the reloading press. Furthermore, in some embodiments, a knurling process can be applied to a top portion 1108 of the marking die 1100. As discussed previously, it should be appreciate that all examples herein are provided for illustrative purposes and that there can be many variations or other possibilities associated with the disclosed technology.

Figure 12:
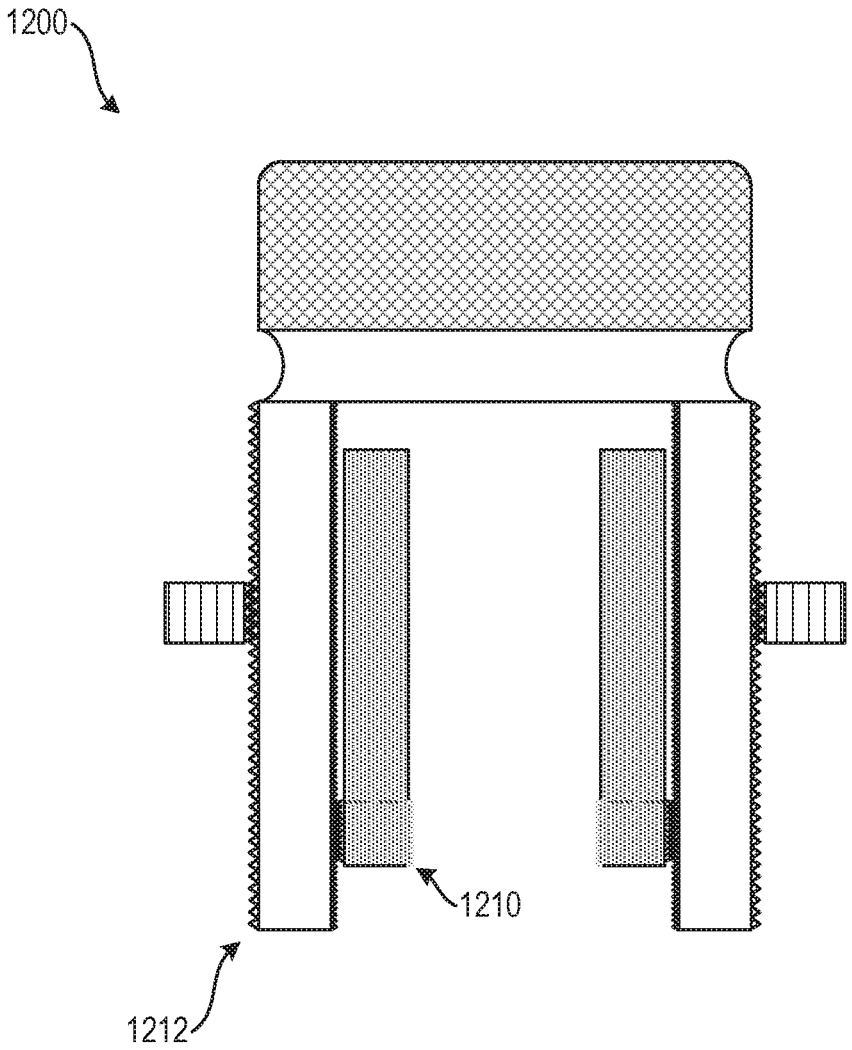
FIG. 12 illustrates a cross-sectional view of an example reloading press complete marking die assembly configured to facilitate identifying cartridge cases based on ink marking, according to an embodiment of the present disclosure.

FIG. 12 illustrates a cross-sectional view of an example reloading press complete marking die assembly 1200 configured to facilitate identifying cartridge cases based on ink marking, according to an embodiment of the present disclosure. Also shown is a cross-sectional view of a marking element 1210. In some implementations, the marking die assembly 1200 can be derived from a combination of parts shown in FIG. 10 and FIG. 11. As shown in FIG. 12, a marking element 1210 can be screwed or otherwise placed in a marking die 1212 to form the marking die assembly 1200. In some cases, the marking element 1210 can be removable, replaceable, and/or interchangeable. For example, the marking element 1210 can be interchangeable based on (the different sizes/diameters of) different cartridge cases. The marking die assembly 1200 can be placed in or affixed to a reloading press via bushings or via screwing. Many variations are possible.

Figure 13:
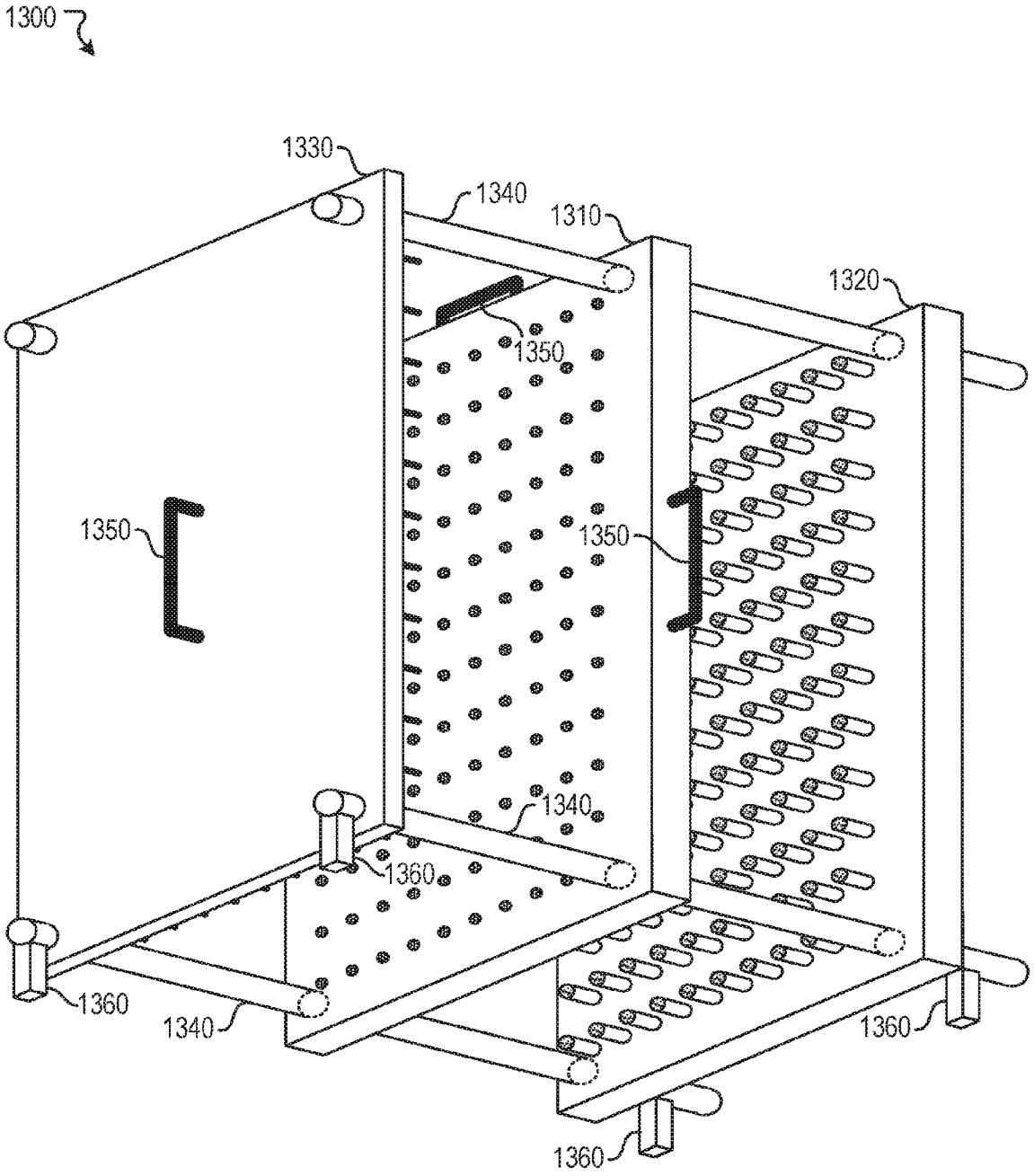
FIG. 13 illustrates an example system configured to facilitate identifying cartridge cases based on ink marking, according to an embodiment of the present disclosure.

FIG. 13 illustrates an example system 1300 configured to facilitate identifying cartridge cases based on ink marking, according to an embodiment of the present disclosure. In some embodiments, the example system 1300 can correspond to a horizontally oriented version of the disclosed technology, similar to the vertically oriented example system 100 of FIG. 1. As shown in FIG. 13, the example system 1300 can include a first platform 1310 (e.g., a securing platform), a second platform 1320 (e.g., a marking platform), and a third platform 1330 (e.g., an ejecting platform). The first platform 1310 can be configured to facilitate removably securing a set of cartridge cases, such as by utilizing a set of case holder elements (e.g., case holding holes, case holding pins, etc.). More details regarding the first platform 1310 will be provided below with reference to FIG. 16 and FIG. 18.

The second platform 1320 can be configured to facilitate providing a set of marking elements (e.g., ink marking tubes) for marking, labeling, or coloring, etc., the set of cartridge cases when the first platform 1310 and/or the second platform 1320 is moved to shorten a distance between the first platform 1310 and the second platform 1320. In the example system 1300, when the first platform 1310 is moved/pushed rightward toward or clamped together with the second platform 1320 (or the second platform 1320 can be moved or pushed leftward toward the first platform 1310, or both platforms can be moved together, etc.), cartridge cases removably secured via the first platform 1310 can be marked utilizing the second platform 1320. As discussed above, in some implementations, marking elements can be substantially or entirely embedded (not illustrated in FIG. 13) within the second platform 1320. The second platform 1320 will be discussed in more detail below with reference to FIG. 17.

Further, the third platform 1330 can be configured to facilitate providing a set of case ejection elements (e.g., case ejecting pins). The third platform 1330 (and/or the first platform 1310) can be moved to shorten a distance between the third platform 1330 and the first platform 1310, such that the set of cartridge cases removably secured on the first platform 1310 can be ejected based on the set of case ejection elements. In the example system 1300, when the third platform 1330 is moved or pushed rightward toward the first platform 1310 (or the first platform 1310 can be moved or pushed leftward toward the third platform 1330, or both platforms can be moved together, etc.), cartridge cases removably secured via the first platform 1310 can be ejected utilizing the third platform 1330. More details regarding the third platform 1330 will be provided below with reference to FIG. 15.

The example system 1300 can also include one or more alignment mechanisms 1340 (e.g., alignment rods, guiding pins, poles, etc.) configured to maintain alignment between the first platform 1310, the second platform 1320, and/or the third platform 1330. Moreover, the example system 1300 can include one or more handles 1350 to facilitate moving various platforms. Additionally, one or more footing elements 1360 can enable the example system 1300 to stand and/or be stabilized while being horizontally oriented, as shown. It should be understood that all examples herein are provided for illustrative purposes and that there can be many variations associated with the disclosed technology.

Figure 14:
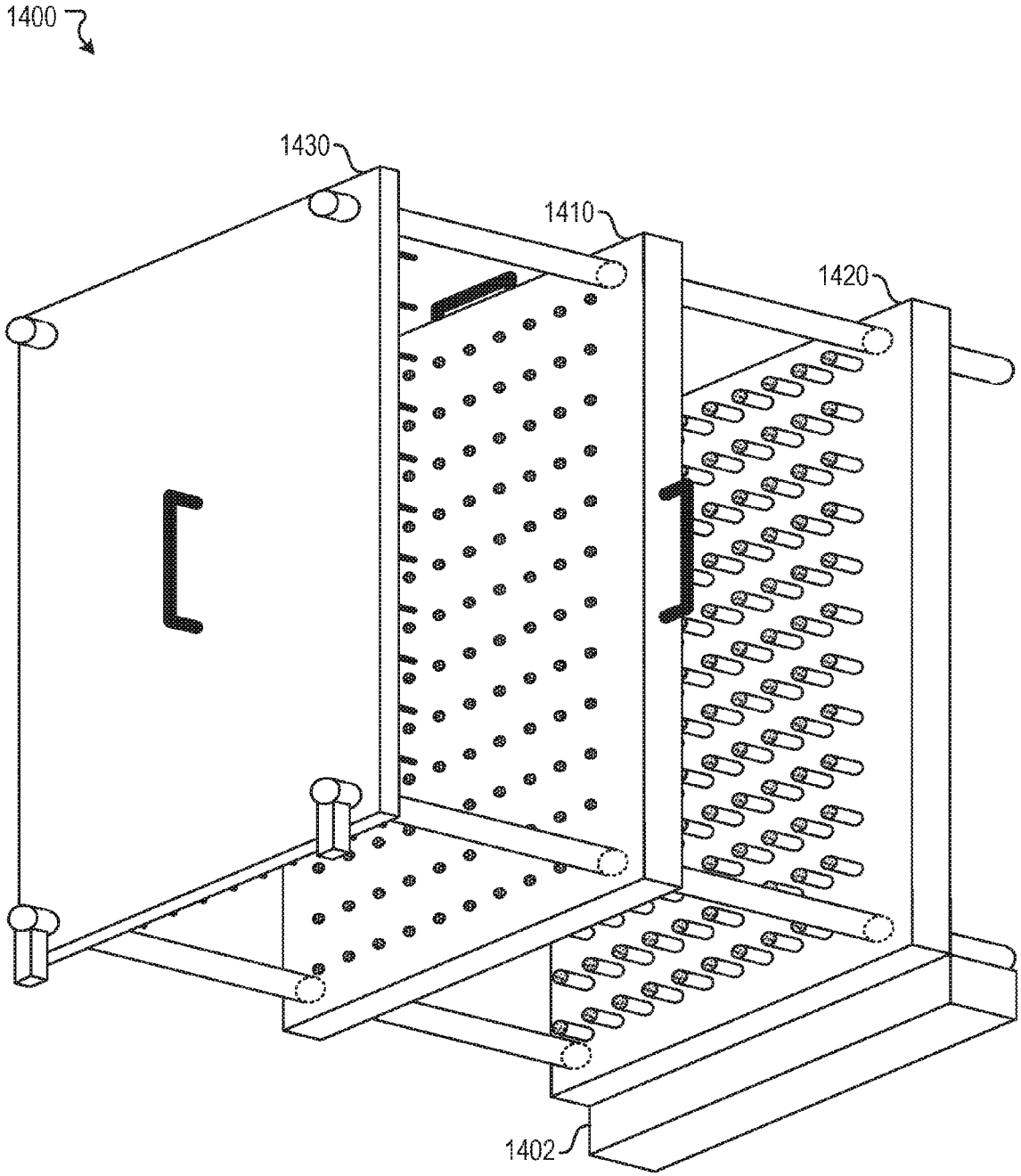
FIG. 14 illustrates an example system configured to facilitate identifying cartridge cases based on ink marking, according to an embodiment of the present disclosure.

FIG. 14 illustrates an example system 1400 configured to facilitate identifying cartridge cases based on ink marking, according to an embodiment of the present disclosure. The example system 1400 can include a first platform 1410 (e.g., a securing platform), a second platform 1420 (e.g., a marking platform), and a third platform 1430 (e.g., an ejecting platform). The example system 1400 can also include a case collection element 1402 (e.g., a case collection bin, a case collection box, a case collection plate, etc.). In the example of FIG. 14, the case collection element 1402 can be positioned right of the second platform 1420. Cartridge cases that are marked via the second platform 1420 can be ejected by the third platform 1430 when the first platform 1410 and the third platform 1430 are moved or clamped together. As such, the marked cartridge cases can be removed or ejected, and can pass through the second platform 1420, thereby falling into the case collection element 1402. In some implementations, the case collection element 1402 can be movable and/or detachable from the example system 1400 for convenient access to the marked and ejected cartridge cases.

Again, many variations associated with the disclosed technology are possible. For example, in some embodiments, the marked cartridge cases need not pass through marking elements and/or the second platform 1420. As such, the marking elements and/or the second platform 1420 need not be entirely hollow. In one instance, the cartridge cases can be marked via the second platform 1420 and then the first platform 1410 can be moved backward away from the second platform 1420. In this instance, the marked cartridge cases can be ejected in between the first platform 1410 and the second platform 1420. Further, in this instance, the case collection element can be placed in between the first platform 1410 and the second platform 1420.

Figure 15:
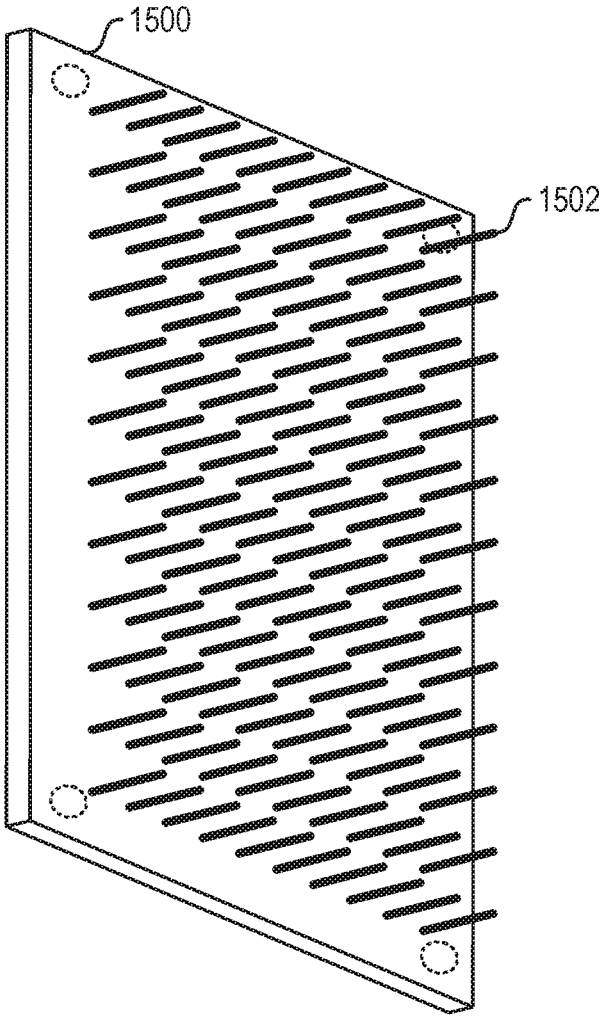
FIG. 15 illustrates an example platform configured to facilitate ejecting cartridge cases subsequent to being identified based on ink marking, according to an embodiment of the present disclosure.

FIG. 15 illustrates an example platform 1500 configured to facilitate ejecting cartridge cases subsequent to being identified based on ink marking, according to an embodiment of the present disclosure. In some embodiments, the example platform 1500 can be implemented as the example third platform 1330 of FIG. 13. FIG. 15 illustrates a view of the example platform 1500 from a rightward perspective. In the example of FIG. 15, the platform 1500 can be shown to provide a set of one or more case ejection elements, such as at least one case ejecting pin 1502.

In some cases, when the example platform 1500 is moved or clamped with a securing platform that removably secures cartridge cases, the case ejection elements (e.g., the at least one case ejecting pin 1502) can push or eject the removable cartridge cases from being held or secured via the securing platform. Accordingly, at least some cartridge cases removably secured at the securing platform can be ejected based on at least some of the set of case ejection elements.

Moreover, in some implementations, the outer diameter of each of the case ejection elements (e.g., case ejecting pins) can be less than the smallest inner diameter of each case holder element that removably secures each cartridge case, less than the smallest cartridge case inner diameter that surrounds a cartridge head, and less than the smallest inner diameter of each marking element that marks each cartridge case. Additionally, the length of each of the case ejection elements (e.g., case ejecting pins) can vary, but can be long enough to eject the cartridge cases. In one instance, the length of a case ejection element (e.g., case ejecting pin) can be at least as long as, within an allowable deviation, the distance between one end (or a front/left surface) of a securing platform and an opposite end (or rear/right edge) of a case holder element in the securing platform. In another instance, the length of a case ejection element can be at least as long as, within an allowable deviation, the combined thickness of the securing platform and the marking platform when clamped together. Again, many variations are possible.

Figure 16:
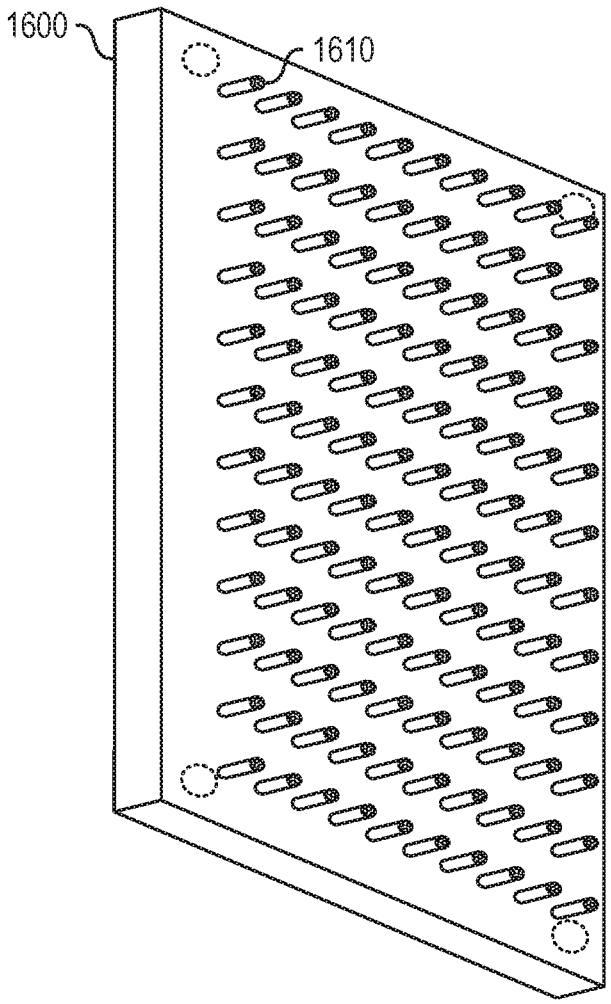
FIG. 16 illustrates an example platform configured to facilitate removably securing cartridge cases to be identified based on ink marking, according to an embodiment of the present disclosure.

FIG. 16 illustrates an example platform 1600 configured to facilitate removably securing cartridge cases to be identified based on ink marking, according to an embodiment of the present disclosure. In some embodiments, the example platform 1600 can be implemented as the first platform 1310 of FIG. 13. FIG. 16 illustrates a view of the example platform 1600 from a rightward perspective. The example platform 1600 can be configured to facilitate removably securing a set of cartridge cases. In some embodiments, the example (securing) platform 1600 can provide a set of case holder elements, such that each cartridge case out of the set of cartridge cases can be removably secured on the securing platform 1600 by a respective case holder element out of the set of case holder elements. In one example, as shown in FIG. 16, each case holder element can correspond to a case holding pin 1610 (i.e., mounting pin). In this example, the outer diameter of the case holding pin 1610 can match, or be less than, the (smallest) inner diameter of each cartridge case (e.g., the smallest cartridge case inner diameter that surrounds a cartridge head). More details are provided in FIG. 18.

Figure 17:
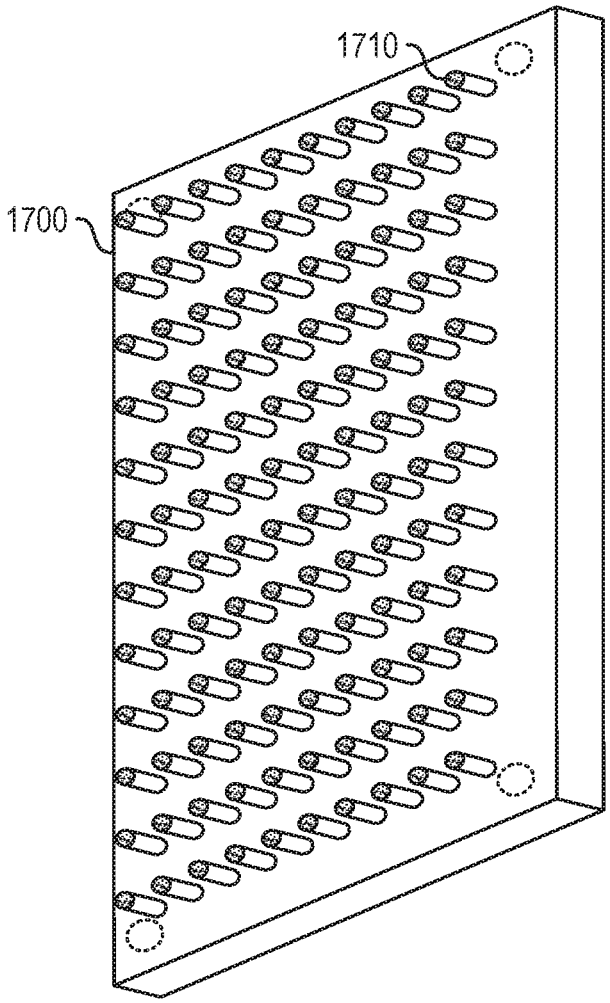
FIG. 17 illustrates an example platform configured to facilitate providing marking elements for identifying cartridge cases, according to an embodiment of the present disclosure.

FIG. 17 illustrates an example platform 1700 configured to facilitate providing marking elements for identifying cartridge cases, according to an embodiment of the present disclosure. In some embodiments, the example platform 1700 can be implemented as the second platform 1320 of FIG. 13. FIG. 17 illustrates a view of the example platform 1700 from a leftward perspective. The example platform 1700 can be configured to facilitate providing a set of marking elements, such as at least one ink marking tube 1710 (i.e., inking tube, coloring die, etc.). In some cases, each cartridge case in a subset of a set of cartridge cases removably secured via a securing platform can be marked by a respective marking element in a subset of the set of marking elements provided by the example (marking) platform 1700. For instance, each marking element in the subset of the set of marking elements can be configured to mark a respective cartridge case in the subset of the set of cartridge cases. Many variations are possible. For example, in some embodiments, ink marking tubes can be substantially or entirely embedded (not illustrated in FIG. 17) within the marking platform 1700.

Figure 18:
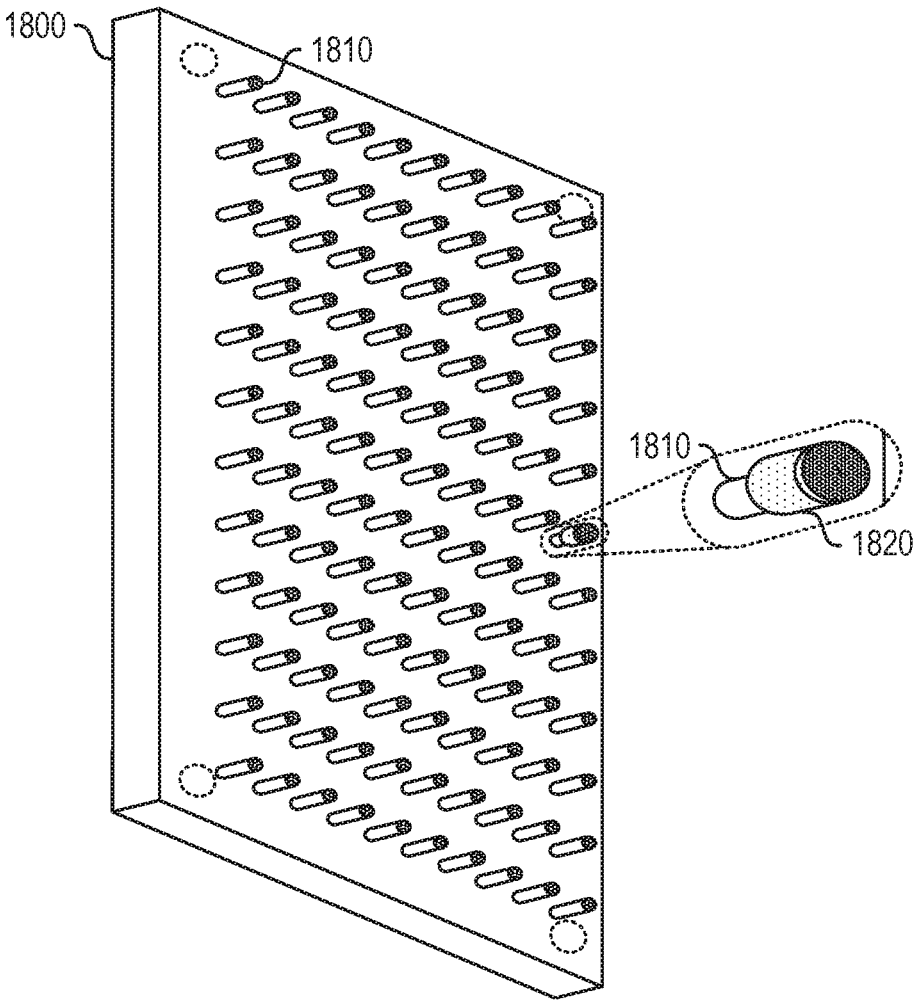
FIG. 18 illustrates an example platform configured to facilitate removably securing cartridge cases to be identified based on ink marking, according to an embodiment of the present disclosure.

FIG. 18 illustrates an example platform 1800 configured to facilitate removably securing cartridge cases to be identified based on ink marking, according to an embodiment of the present disclosure. In some embodiments, the example platform 1800 can be implemented as the first platform 1310 of FIG. 13. FIG. 18 illustrates a view of the example platform 1800 from a rightward perspective.

The example platform 1800 can be configured to facilitate removably securing a set of cartridge cases. In some embodiments, the example (securing) platform 1800 can provide a set of case holder elements, such that each cartridge case out of the set of cartridge cases can be removably secured on the securing platform 1800 by a respective case holder element out of the set of case holder elements. As shown in the example of FIG. 18, each case holder element can correspond to a case holding pin 1810 (i.e., mounting pin). In this example, the outer diameter of the case holding pin 1810 can match, or be less than, the (smallest) inner diameter of a respective cartridge case 1820 removably secured by the case holding pin 1810. The cartridge case 1820 can be slid or placed onto the case holding pin 1810 via the cartridge case's opening. In this orientation, the opening/front/top of the cartridge case 1820 is closer to the securing platform 1800 than is the rim/rear/bottom of the cartridge case 1820. Furthermore, in some implementations, the case holding pin 1810 can be hollow and/or the protruding end of the case holding pin 1810 can have a hole, such that a case ejection element (e.g., a case ejecting pin) can pass through the case holding pin 1810 to eject the cartridge case 1820. It also follows that the smallest inner diameter of the hollow case holding pin 1810 (or the diameter of the hole on the protruding end of the case holding pin 1810) should be greater than the outer diameter of the case ejecting pin. It should be appreciated that many variations associated with the disclosed technology are possible. For instance, it is contemplated that pistol cartridge cases or rifle cartridge cases can be placed on (and removably secured via) case holding pins. Moreover, although a single cartridge case is explicitly illustrated in various figures, it should be understood that a set of multiple cartridge cases can be utilized with the disclosed technology.

Figure 19:
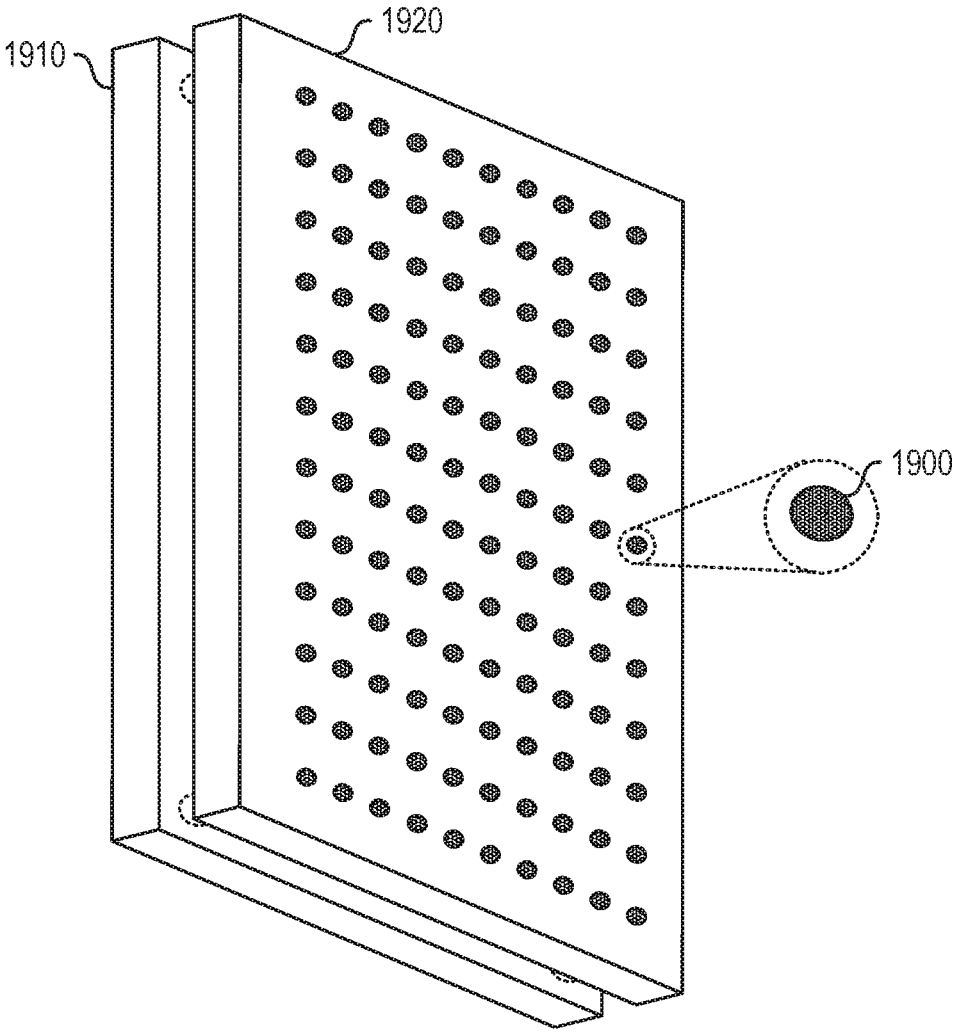
FIG. 19 illustrates an example cartridge case that is removably secured and being marked, according to an embodiment of the present disclosure.

FIG. 19 illustrates an example cartridge case 1900 that is removably secured and being marked, according to an embodiment of the present disclosure. In the example of FIG. 19, the example cartridge case 1900 can be removably secured via (a case holder element of) a securing platform 1910 and can be marked via (a marking element of) a marking platform 1920. As shown, only the rear/bottom of the cartridge case 1900 appears to be visible as the cartridge case 1900 is passing through the marking platform 1920 while being marked.

Figure 20:
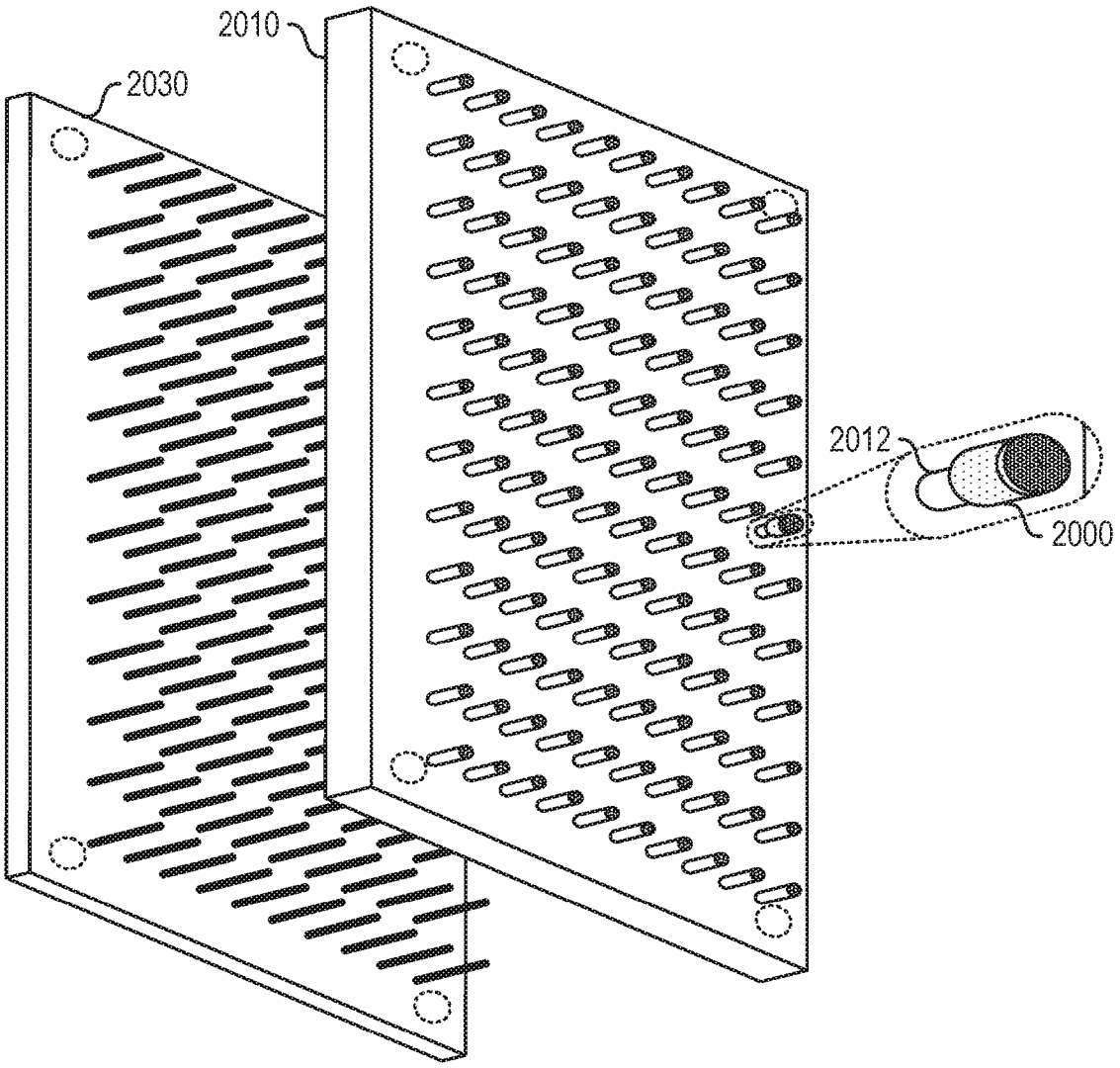
FIG. 20 illustrates an example removably secured cartridge case that is to be ejected by a case ejection element, according to an embodiment of the present disclosure.

FIG. 20 illustrates an example removably secured cartridge case 2000 that is to be ejected by a case ejection element, according to an embodiment of the present disclosure. In the example of FIG. 20, the example cartridge case 2000 can be removably secured via (a case holding pin 2012 of) a securing platform 2010. As shown in FIG. 20, there can also be a ejecting platform 2030 that provides the case ejection element for ejecting the cartridge case 2000, such as when the cartridge case 2000 has been marked.

Figure 21:
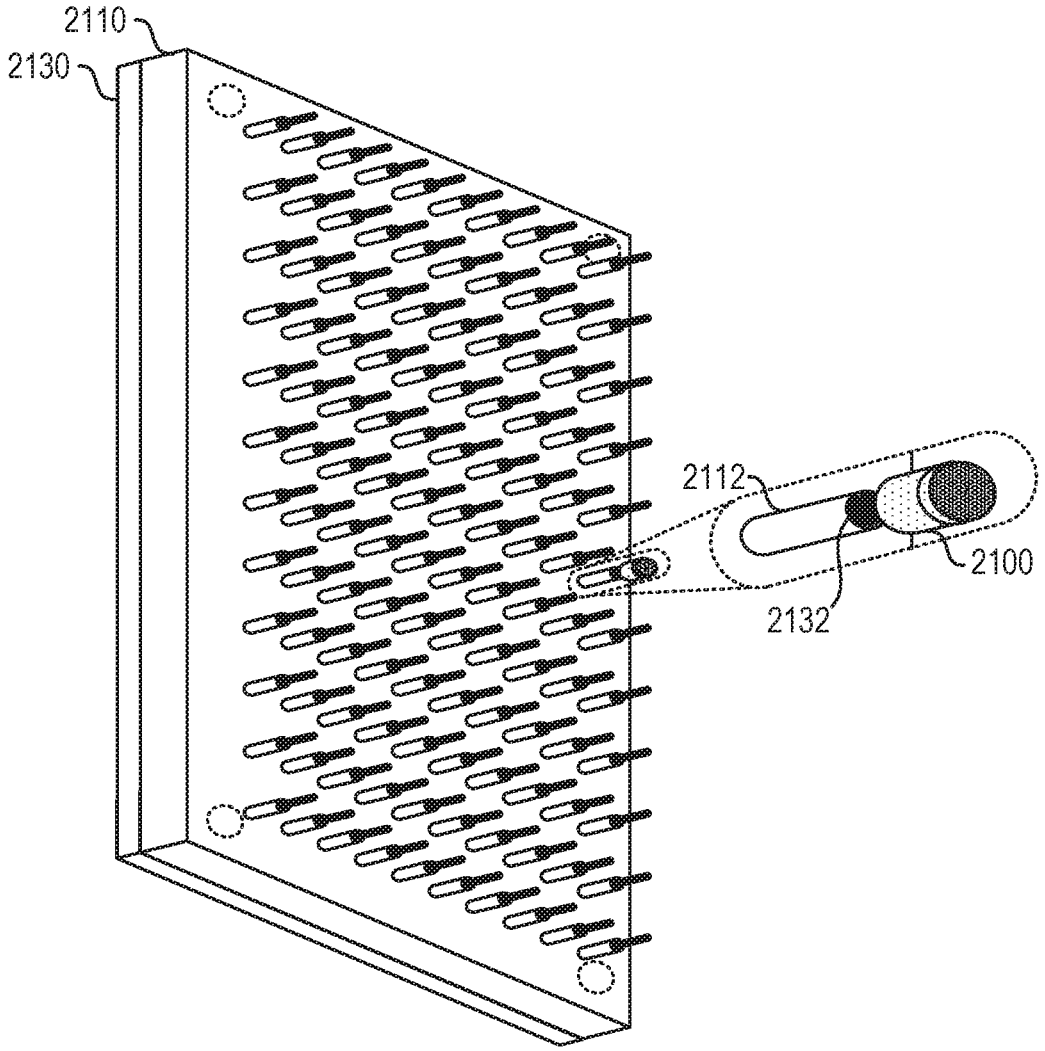
FIG. 21 illustrates an example cartridge case that is being ejected by a case ejection element, according to an embodiment of the present disclosure.
Figure 22:
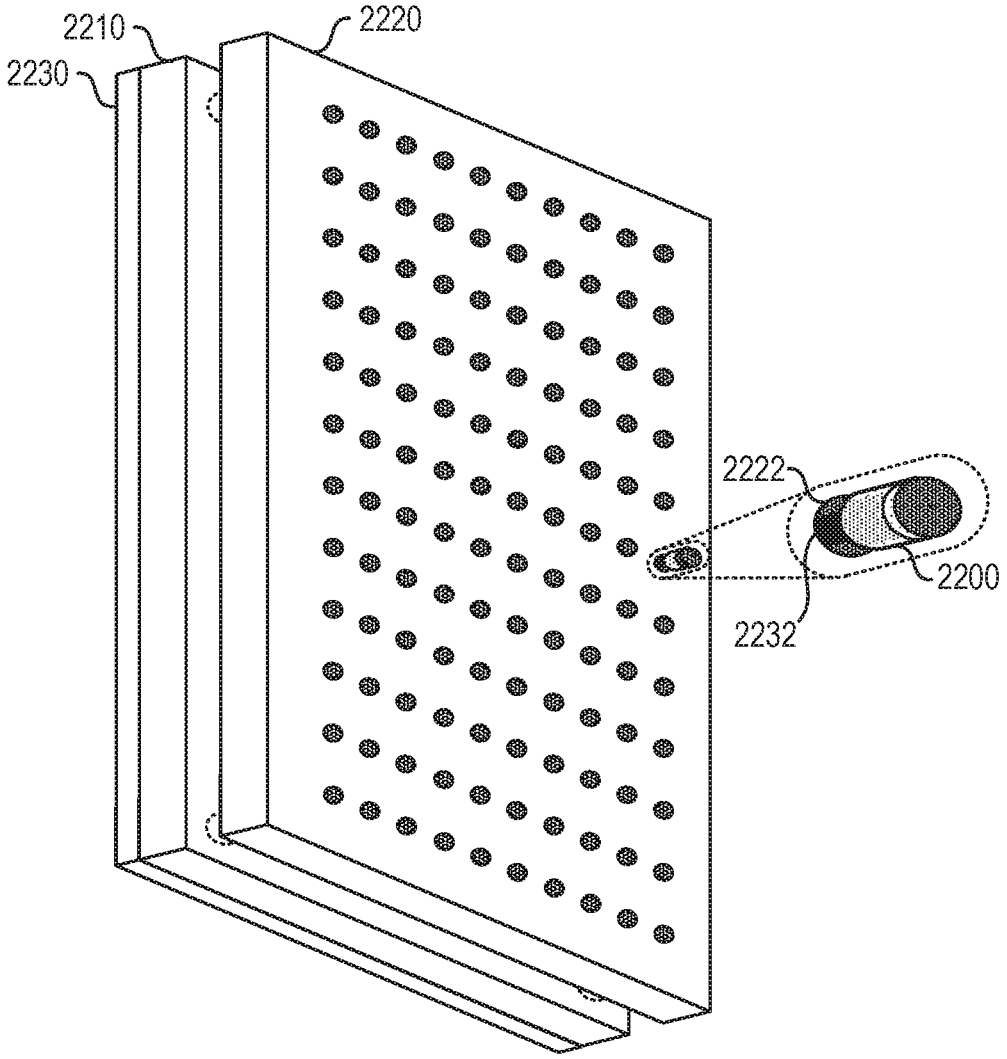
FIG. 22 illustrates an example marked cartridge case that is being ejected by a case ejection element, according to an embodiment of the present disclosure.

FIG. 21 illustrates an example cartridge case 2100 that is being ejected by a case ejection element 2132, according to an embodiment of the present disclosure. In the example of FIG. 21, the example cartridge case 2100 had been previously secured via (a case holding pin 2112 of) a securing platform 2110. In FIG. 21, the securing platform 2110 has been moved or clamped together with an ejecting platform 2130. As shown, a respective case ejecting pin 2132 of the ejecting platform 2130 can pass through the case holding pin 2112 and can push the cartridge case 2100 off of the case holding pin 2112. As a result, the cartridge case 2100 is being ejected by the case ejecting pin 2132. In some cases, the cartridge case 2100 can be ejected by the case ejecting pin 2132 subsequent to being marked via (a marking element of) a marking platform, which is not explicitly illustrated in FIGURE FIG. 22 illustrates an example marked cartridge case 2200 that is being ejected by a case ejection element 2232, according to an embodiment of the present disclosure. In the example of FIG. 22, the example cartridge case 2200 had been previously secured via (a case holding pin of) a securing platform 2210. The securing platform 2210 had also been moved or clamped together with a marking platform 2220. As such, the example cartridge case 2200 has also been marked via (a marking element 2222 of) the marking platform 2220. Further, the securing platform 2210 has been moved or clamped together with an ejecting platform 2230. Accordingly, a respective case ejecting pin 2232 of the ejecting platform 2230 can pass through (the case holding pin of) the securing platform 2210 and (the marking element 2222 of) the marking platform 2220. The respective case ejecting pin 2232 can push the cartridge case 2200 off of the case holding pin of the securing platform 2210 and through the marking element 2222 and the marking platform 2220. As a result, the cartridge case 2200 is being ejected by the case ejecting pin 2232.

Figure 23:
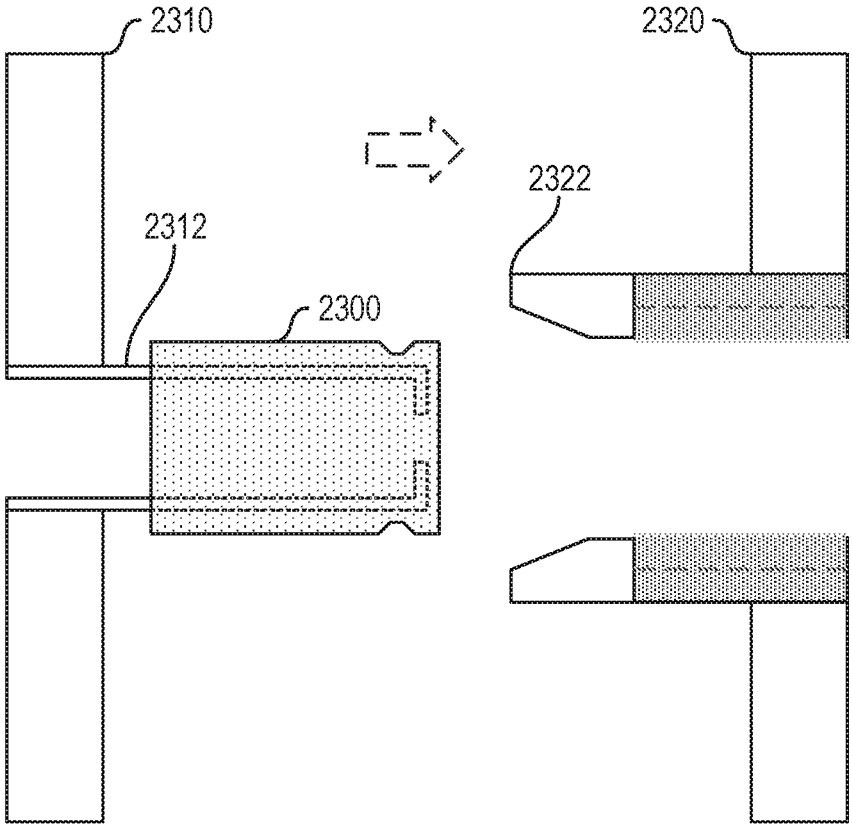
FIG. 23 illustrates a cross-sectional view of an example removably secured cartridge case that is to be marked by a marking element, according to an embodiment of the present disclosure.

FIG. 23 illustrates a cross-sectional view of an example removably secured cartridge case 2300 that is to be marked by a marking element 2322, according to an embodiment of the present disclosure. As shown in FIG. 23, there can also be a securing platform 2310 and a marking platform 2320. The cartridge case 2300 can be removably secured via a case holding pin 2312 of the securing platform 2310. Moreover, when the securing platform 2310 and the marking platform 2320 are moved or clamped together (e.g., when the securing platform 2310 is moved rightward), the marking element 2322 provided via the marking platform 2320 can mark, label, and/or color, etc., the cartridge case 2300 removably secured at the securing platform 2310.

Figure 24:
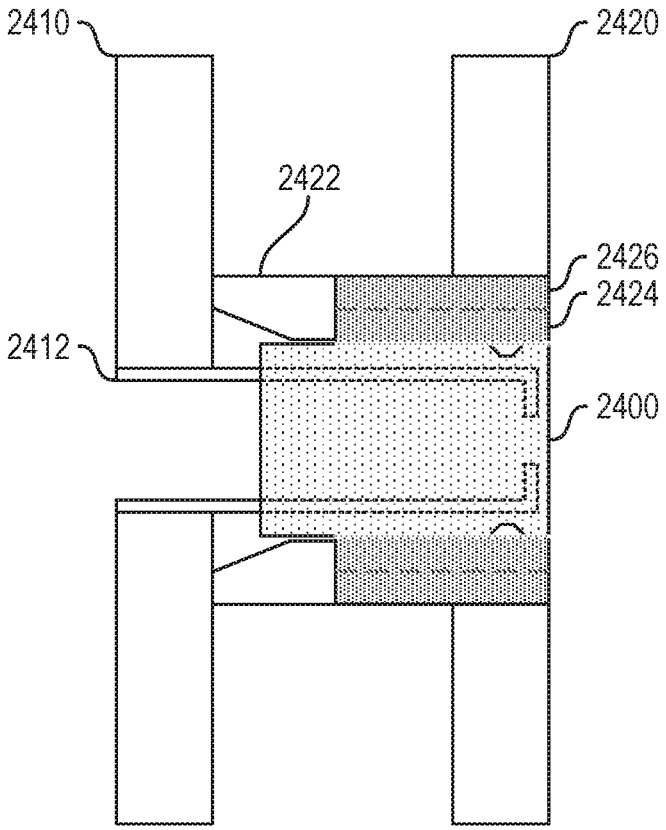
FIG. 24 illustrates a cross-sectional view of an example removably secured cartridge case that is being marked by a marking element, according to an embodiment of the present disclosure.

FIG. 24 illustrates a cross-sectional view of an example removably secured cartridge case 2400 that is being marked by a marking element 2422, according to an embodiment of the present disclosure. FIG. 24 also shows a securing platform 2410 and a marking platform 2420. In FIG. 24, the cartridge case 2400 can be removably secured via a case holding pin 2412 of the securing platform 2410. Also, as shown, the securing platform 2410 and the marking platform 2420 can be moved or clamped together. Accordingly, the marking element 2422 provided via the marking platform 2420 can mark, label, and/or color, etc., the cartridge case 2400 removably secured at the securing platform 2410. For instance, at least one ink marking pad 2424 (whose ink can be supplied by at least one ink well/tank 2426) can mark at least a portion of an outer surface of the cartridge case 2400 when the at least one marking pad 2424 makes physical contact with at least the portion of the outer surface of the cartridge case 2400, which can be caused by the securing platform 2410 and the marking platform 2420 being moved or clamped together.

Figure 25:
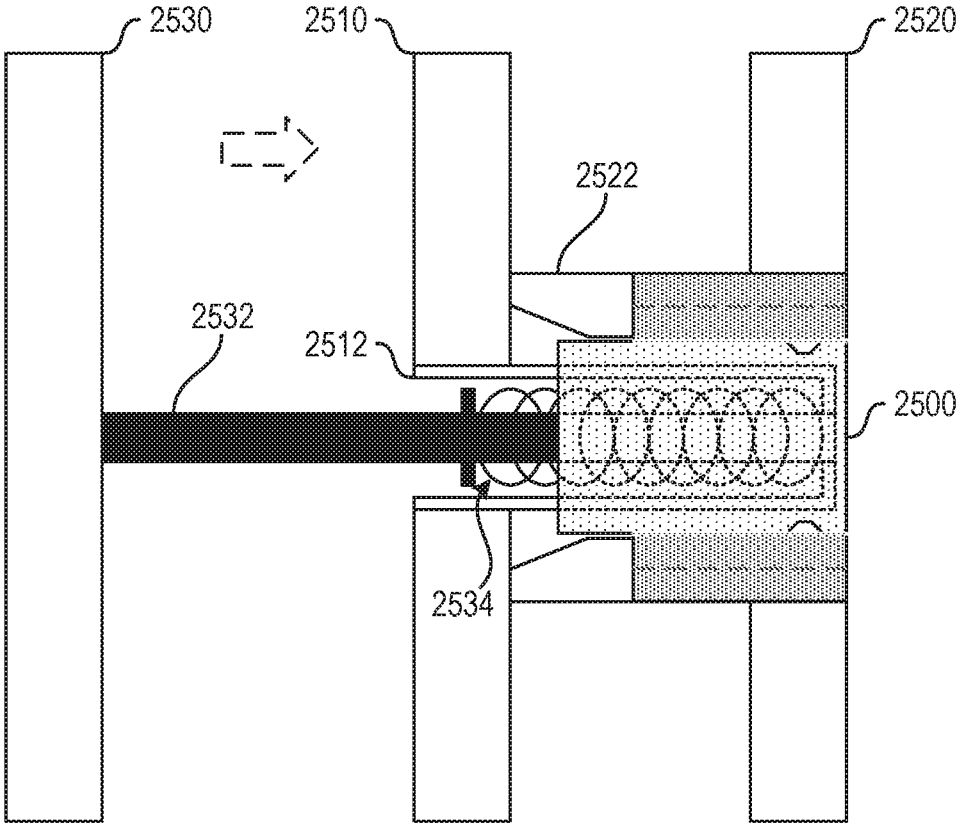
FIG. 25 illustrates a cross-sectional view of an example removably secured cartridge case that is being marked by a marking element and that is to be ejected by a case ejection element, according to an embodiment of the present disclosure.

FIG. 25 illustrates a cross-sectional view of an example removably secured cartridge case 2500 that is being marked by a marking element 2522 and that is to be ejected by a case ejection element 2532, according to an embodiment of the present disclosure. In FIG. 25, the cartridge case 2500 can be removably secured via a case holding pin 2512 of a securing (or core holding) platform 2510. The securing platform 2510 and a marking platform 2520 can be moved or clamped together, such that the marking element 2522 of the marking platform 2520 can mark the cartridge case 2500. Furthermore, as shown in the example of FIG. 25, an ejecting platform 2530 including the case ejection element 2532 (e.g., a case ejecting pin) can be moved rightward. In some embodiments, the case ejection element 2532 can utilize a reversion system 2534, including a spring or another compression system, that enables the case ejection element 2532 and the ejecting platform 2530 to revert back into a non-ejection or pre-ejection state after being used. In some cases, an alternate universal/master reversion system (not explicitly illustrated in FIG. 25) can utilize a compression spring between the ejecting platform 2530 and the securing platform 2510.

Figure 26:
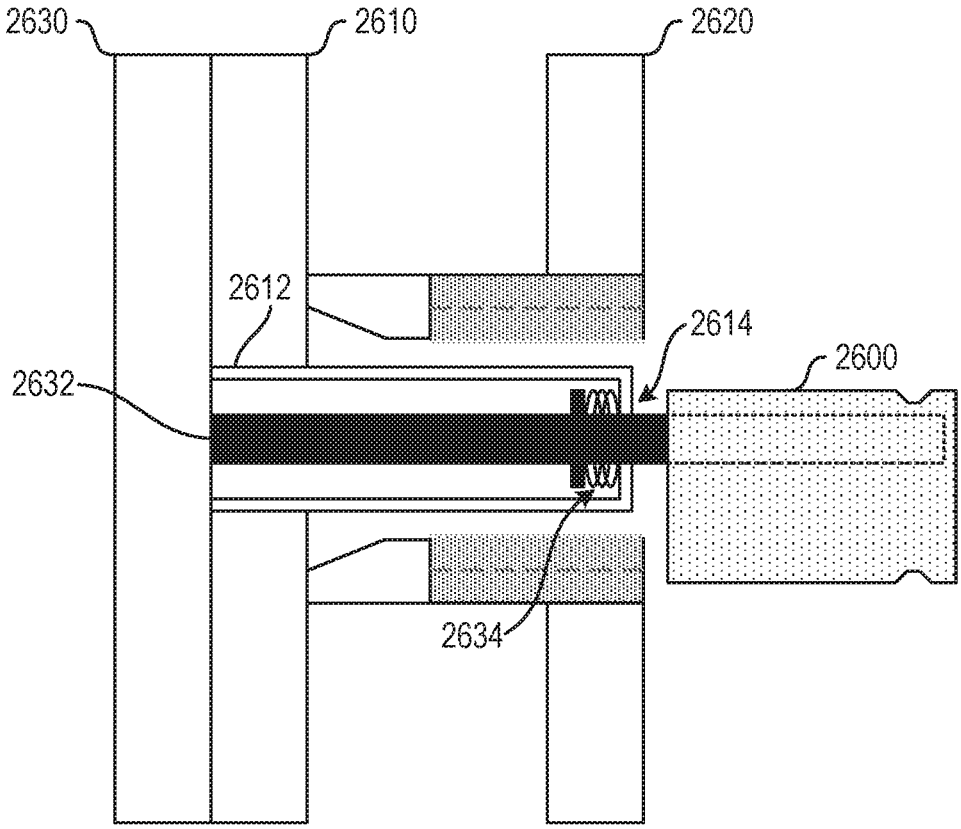
FIG. 26 illustrates a cross-sectional view of an example marked cartridge case that is being ejected by a case ejection element, according to an embodiment of the present disclosure.

FIG. 26 illustrates a cross-sectional view of an example marked cartridge case 2600 that is being ejected by a case ejection element 2632, according to an embodiment of the present disclosure. As shown, having been marked via a marking platform 2620, the cartridge case 2600 can be ejected from being removably secured at a securing platform 2610 via a case holding pin 2612 of the securing platform 2610. In the example of FIG. 26, an ejection platform 2630 including a case ejecting pin 2632 can be moved or clamped together with the securing platform 2610. As such, the case ejecting pin 2632 can pass through a hole at the protruding end 2614 of the case holding pin 2612 and can push the cartridge case 2600 off of the case holding pin 2612, which had been removably securing the cartridge case 2600. Additionally, in this example, a reversion system 2634 can be triggered or initiated, which can cause the ejecting platform 2630 and the case ejecting pin 2632 to be moved leftward, thereby causing their reversion back into a non-ejection or pre-ejection state.

Figure 27:
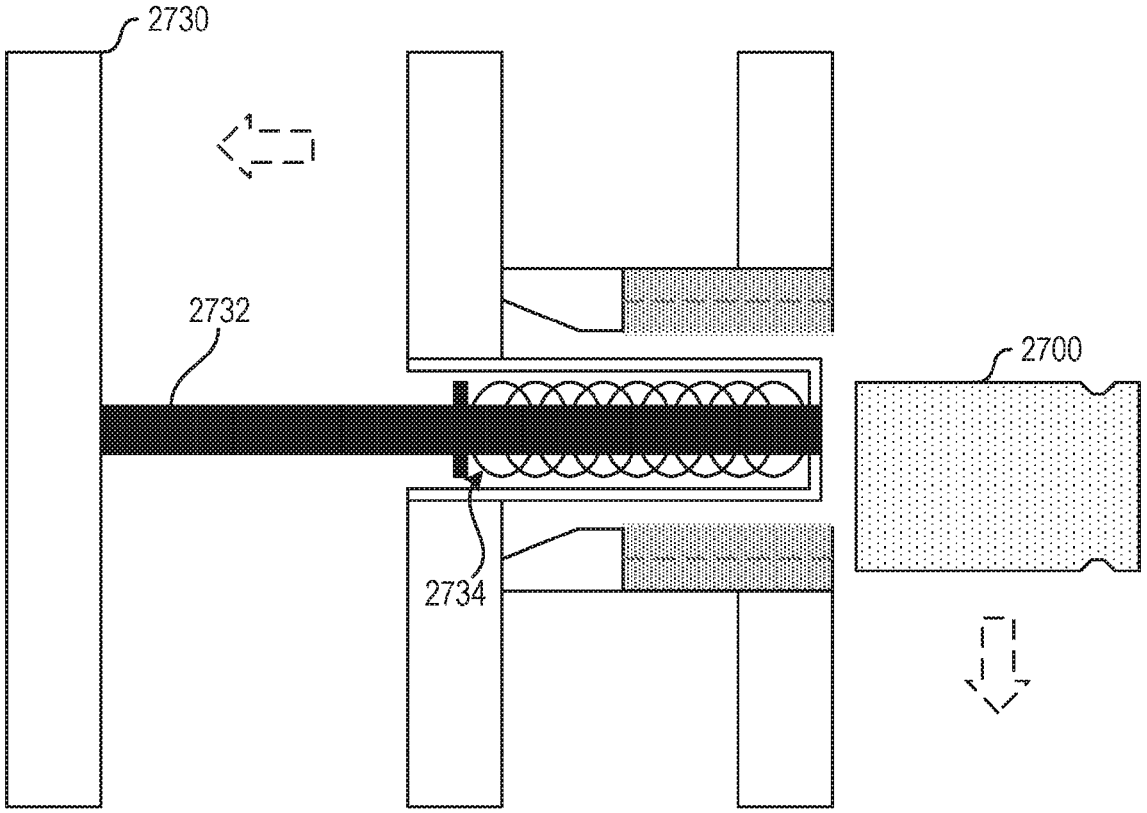
FIG. 27 illustrates a cross-sectional view of an example marked cartridge case that has been ejected by a case ejection element, according to an embodiment of the present disclosure.

FIG. 27 illustrates a cross-sectional view of an example marked cartridge case 2700 that has been ejected by a case ejection element 2732, according to an embodiment of the present disclosure. As shown, having been ejected via a case ejecting pin 2732 of an ejecting platform 2730, the cartridge case 2700 can drop or fall, such as into a case collection element (not explicitly illustrated in the example of FIG. 27). Further, in this example, a reversion system 2734 can cause the ejecting platform 2730 and the case ejecting pin 2732 to be moved leftward, thereby causing their reversion back into a non-ejection or pre-ejection state. As discussed previously, it should be appreciated that many variations associated with the disclosed technology are possible. For example, in some instances, manual effort can be utilized, in addition to or instead of the reversion system 2734, to move the ejecting platform 2730 and the case ejecting pin 2732 leftward, thereby causing their reversion back into the non-ejection or pre-ejection state.

Figure 28:
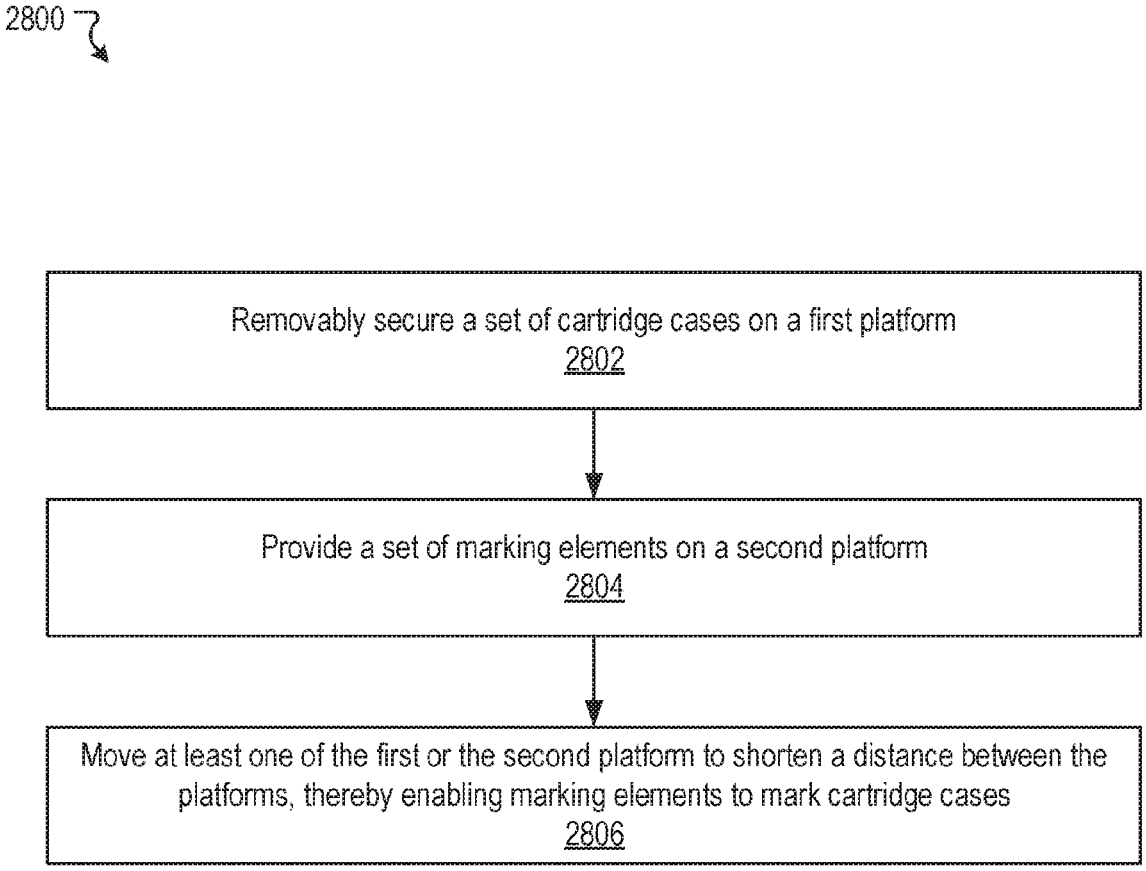
FIG. 28 illustrates an example method associated with identifying cartridge cases based on ink marking, according to an embodiment of the present disclosure.

FIG. 28 illustrates an example method 2800 associated with identifying cartridge cases based on ink marking, according to an embodiment of the present disclosure. It should be appreciated that there can be additional, fewer, or alternative steps performed in similar or alternative orders, or in parallel, within the scope of the various embodiments unless otherwise stated.

At block 2802, the example method 2800 can removably secure a set of cartridge cases on a first platform. At block 2804, the example method 2800 can provide a set of marking elements on a second platform. At block 2806, the example method 2800 can move at least one of the first platform or the second platform to shorten a distance between the first platform and the second platform. At least a subset of the set of marking elements can thereby be enabled to mark at least a subset of the set of cartridge cases.

Figure 29:
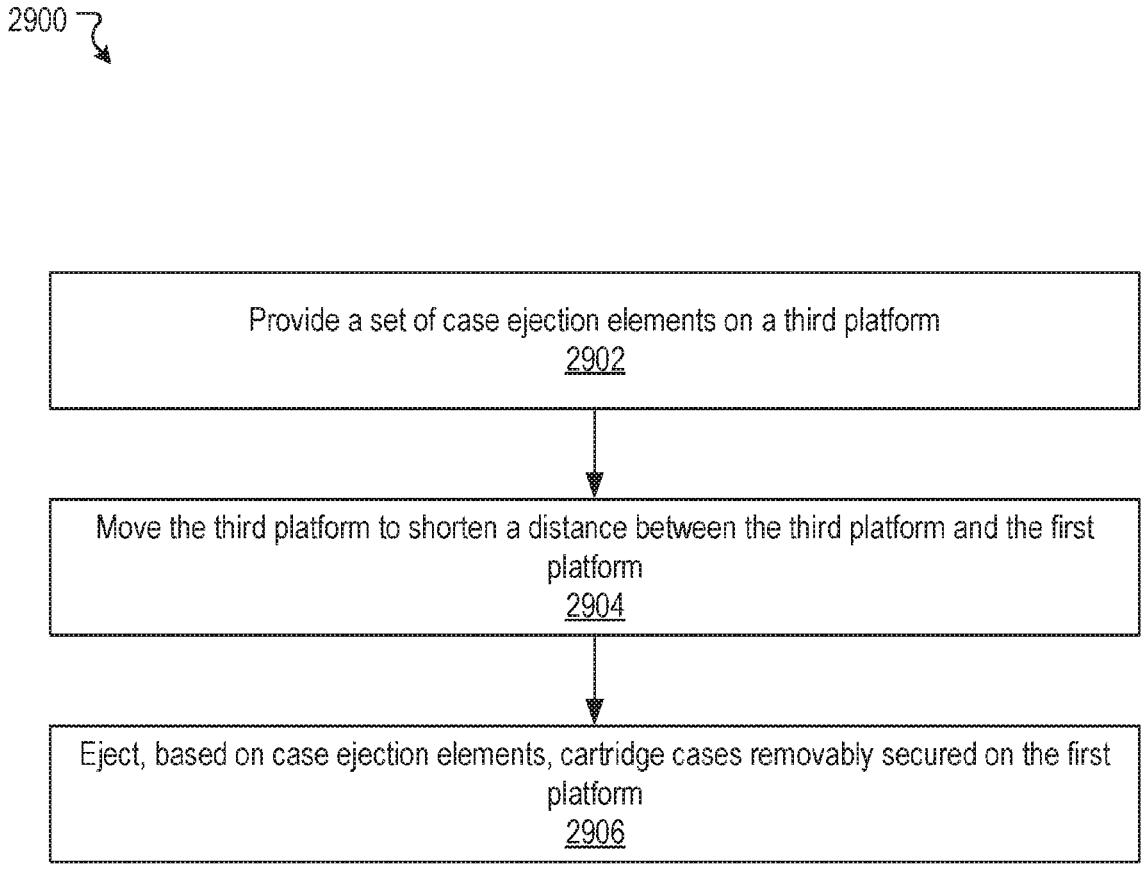
FIG. 29 illustrates an example method associated with identifying cartridge cases based on ink marking, according to an embodiment of the present disclosure.

FIG. 29 illustrates an example method 2900 associated with identifying cartridge cases based on ink marking, according to an embodiment of the present disclosure. As discussed, it should be understood that there can be additional, fewer, or alternative steps performed in similar or alternative orders, or in parallel, within the scope of the various embodiments unless otherwise stated.

At block 2902, the example method 2900 can provide a set of case ejection elements on a third platform. At block 2904, the example method 2900 can move the third platform to shorten a distance between the third platform and the first platform. At block 2906, the example method 2900 can eject, based on at least a subset of the set of case ejection elements, at least the subset of the set of cartridge cases removably secured on the first platform.

It is contemplated that there can be many other uses, applications, features, possibilities, and/or variations associated with the various embodiments of the present disclosure. For example, users can, in some cases, choose whether or not to opt-in to utilize the disclosed technology. The disclosed technology can, for instance, also ensure that various privacy settings and preferences are maintained and can prevent private information from being divulged. In another example, various embodiments of the present disclosure can learn, improve, and/or be refined over time.

In some embodiments, marking elements can correspond to or can match cartridge calibers/diameters. In some cases, marking elements can be spring designed to provide universal use or use for a range of cartridge calibers. In some instances, marking element be of a universal type or an individual cartridge type. Moreover, in some implementations, ink utilized with the disclosed technology can be built into individual markers or can be provided via a central irrigation arterial system with a common ink well. Also, the disclosed technology can be used as described and/or with plates mounted to a mechanical hand press or an electromechanical system. Furthermore, in some cases, the cartridge cases can be cleaned to improve ink adherence. In some embodiments, the ink can be of a temporary marking type. In some instance, the ink can be thin and need not affect various functions of firearms. Again, many variations associated with the disclosed technology are possible.

For purposes of explanation, numerous specific details are set forth in order to provide a thorough understanding of the description. It will be apparent, however, to one skilled in the art that embodiments of the disclosure can be practiced without these specific details. In some instances, modules, structures, processes, features, and devices are shown in block diagram form in order to avoid obscuring the description. In other instances, functional block diagrams and flow diagrams are shown to represent data and logic flows. The components of block diagrams and flow diagrams (e.g., modules, blocks, structures, devices, features, etc.) may be variously combined, separated, removed, reordered, and replaced in a manner other than as expressly described and depicted herein.

Reference in this specification to "one embodiment", "an embodiment", "other embodiments", "one series of embodiments", "some embodiments", "various embodiments", or the like means that a particular feature, design, structure, or characteristic described in connection with the embodiment is included in at least one embodiment of the disclosure. The appearances of, for example, the phrase "in one embodiment" or "in an embodiment" in various places in the specification are not necessarily all referring to the same embodiment, nor are separate or alternative embodiments mutually exclusive of other embodiments. Moreover, whether or not there is express reference to an "embodiment" or the like, various features are described, which may be variously combined and included in some embodiments, but also variously omitted in other embodiments. Similarly, various features are described that may be preferences or requirements for some embodiments, but not other embodiments. Furthermore, reference in this specification to "based on" can mean "based, at least in part, on", "based on at least a portion/part of", "at least a portion/part of which is based on", and/or any combination thereof.

The language used herein has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A method comprising:

removably securing a set of cartridge cases on a first platform;

providing a set of marking elements on a second platform;

providing a set of case ejection elements on a third platform;

moving at least one of the first platform or the second platform to shorten a distance between the first platform and the second platform, thereby enabling at least a subset of the set of marking elements to mark at least a subset of the set of cartridge cases; and moving at least one of the first platform or the third platform to shorten a distance between the first platform and the third platform, thereby enabling at least a subset of the set of case ejectment elements to eject at least a subset of the set of cartridge cases.

2. The method of claim 1, wherein at least the subset of the set of cartridge cases are ejected into a case collection element.

3. The method of claim 1, further comprising:

maintaining, within an allowable deviation, a defined alignment between the first platform and the second platform.

4. The method of claim 3, wherein the defined alignment is linear, wherein a direction associated with the defined alignment is at least one of horizontal or vertical, and wherein the direction is perpendicular with respect to the first platform and the second platform.

5. The method of claim 1, wherein each cartridge case in the set of cartridge cases is removably secured on the first platform based on a respective case holder element out of a set of case holder elements, and wherein each case holder element in the set of case holder elements is associated with at least one of a cutout in a rubber sheet, an elastomer sheet, a washer, a mounting pin, a cartridge specific shell holder, or a universal shell holder.

6. The method of claim 5, wherein at least some case holder elements in the set of case holder elements are interchangeable based on one or more sizes associated with the set of cartridge cases.

7. The method of claim 1, wherein each cartridge case in the subset of the set of cartridge cases is marked by a respective marking element in the subset of the set of marking elements.

8. The method of claim 1, wherein each marking element in at least the subset of the set of marking elements corresponds to a inking tube, wherein a smallest inner diameter of the inking tube is greater than or equal to a largest outer diameter of each cartridge case in the subset of the set of cartridge cases, and wherein each marking element in at least the subset of the set of marking elements is at least one of: 1) provided with the second platform or 2) placed with a respective reloading press marking die in a set of reloading press marking dies associated with the second platform.

9. The method of claim 1, wherein at least one marking element in the set of marking elements utilizes at least one of a plurality of same colored inks or a plurality of differently colored inks.

10. A system comprising:

a first platform configured to removably secure a set of cartridge cases;

a second platform configured to provide a set of marking elements on a second platform;

one or more moving mechanisms configured to facilitate moving at least one of the first platform or the second platform to shorten a distance between the first platform and the second platform, thereby enabling at least a subset of the set of marking elements to mark at least a subset of the set of cartridge cases; and a third platform configured to provide a set of case ejection elements, wherein the third platform is movable to shorten a distance between the third platform and the first platform, and wherein at least a subset of the set of case ejection elements is configured to facilitate ejecting at least the subset of the set of cartridge cases removably secured on the first platform.

11. The system of claim 10, further comprising:

a case collection element configured to receive at least the subset of the set of cartridge cases subsequent to being ejected.

12. The system of claim 10, further comprising:

one or more alignment mechanisms configured to maintain, within an allowable deviation, a defined alignment between the first platform and the second platform.

13. The system of claim 10, wherein the first platform comprises a set of case holder elements, wherein each case holder element out of the set of case holder elements is configured to removably secure a respective cartridge case out of the set of cartridge cases on the first platform, and wherein each case holder element in the set of case holder elements is associated with at least one of a cutout in a rubber sheet, an elastomer sheet, a washer, a mounting pin, a cartridge specific shell holder, or a universal shell holder.

14. The system of claim 13, wherein at least some case holder elements in the set of case holder elements are interchangeable based on one or more sizes associated with the set of cartridge cases.

15. The system of claim 10, wherein each marking element in the subset of the set of marking elements is configured to mark a respective cartridge case in the subset of the set of cartridge cases.

16. The system of claim 10, wherein each marking element in at least the subset of the set of marking elements corresponds to a inking tube, wherein a smallest inner diameter of the inking tube is greater than or equal to a largest outer diameter of each cartridge case in the subset of the set of cartridge cases, and wherein each marking element in at least the subset of the set of marking elements is at least one of: 1) provided with the second platform or 2) placed with a respective reloading press marking die in a set of reloading press marking dies associated with the second platform.

17. The system of claim 10, wherein at least one marking element in the set of marking elements is configured to utilize at least one of a plurality of same colored inks or a plurality of differently colored inks.

18. A cartridge case comprising:

an inner case surface configured to hold a bullet; and an outer case surface configured to be removably secured via a first platform and capable of being marked by at least one marking element on a second platform when at least one of the first platform or the second platform is moved to shorten a distance between the first platform and the second platform, wherein the outer case surface is capable of being ejected by at least one case ejection element on a third platform when at least one of the first platform or the third platform is moved to shorten a distance between the first platform and the third platform.

* * * * *